US005984299A

United States Patent [19]

Hirota et al.

[11] Patent Number: 5,984,299

[45] Date of Patent: Nov. 16, 1999

[54] SHEET FINISHING APPARATUS

[75] Inventors: Kazuhiro Hirota; Hisao Hosoya; Satoru Endo, all of Hachioji; Yuji Kanazawa, Musashino; Takanori Yoshida, Toda; Kazuyoshi Omi, Kawagoe; Mamoru Tomotsune, Yokohama, all of Japan

[73] Assignee: Konica Corporation, Tokyo, Japan

[21] Appl. No.: 09/032,395

[22] Filed: Feb. 27, 1998

[30] Foreign Application Priority Data

Mar. 6, 1997 [JP] Japan ..... 9-051665
Jun. 13, 1997 [JP] Japan ..... 9-156832

[51] Int. Cl.[6] ..... B65H 1/00; B65H 31/14; B65H 39/10

[52] U.S. Cl. ..... 271/161; 271/219; 271/292

[58] Field of Search ..... 270/58.01, 58.08, 270/58.09, 58.12, 58.13, 58.14, 58.19, 58.15; 271/209, 213, 214, 215, 219, 282, 292, 298, 127, 160, 294, 188, 148, 161

[56] References Cited

U.S. PATENT DOCUMENTS

| | | | |
|---|---|---|---|
| 4,400,124 | 8/1983 | Greller | 271/209 |
| 4,751,550 | 6/1988 | Murakami | 271/288 |
| 5,012,294 | 4/1991 | Sasabe et al. | 271/217 |
| 5,046,717 | 9/1991 | Ettischer et al. | 271/219 |
| 5,415,390 | 5/1995 | Guerrero | 271/215 |
| 5,524,873 | 6/1996 | Hosoi et al. | 271/58.08 |
| 5,734,480 | 3/1998 | Kawamura et al. | 271/298 |

FOREIGN PATENT DOCUMENTS

| | | |
|---|---|---|
| 60-142359 | 7/1985 | Japan . |
| 62-239169 | 10/1987 | Japan . |
| 62-288002 | 12/1987 | Japan . |
| 63-116168 | 5/1988 | Japan . |
| 63-267667 | 11/1988 | Japan . |
| 1-127556 | 5/1989 | Japan . |
| 1-214565 | 8/1989 | Japan . |
| 2-276691 | 11/1990 | Japan . |
| 5-41991 | 6/1993 | Japan . |
| 7-76190 | 3/1995 | Japan . |
| 60-158463 | 8/1995 | Japan . |
| 9-235069 | 9/1997 | Japan . |

*Primary Examiner*—William E. Terrell
*Assistant Examiner*—K W Bower
*Attorney, Agent, or Firm*—Frishauf, Holtz, Goodman, Langer & Chick, P.C.

[57] ABSTRACT

A sheet finishing apparatus for finishing a sheet, on which an image has been formed, conveyed from an image forming apparatus, the sheet finishing apparatus includes: a sheet ejecting member for ejecting the sheet after finishing; and an exit tray for receiving the sheet ejected by the sheet ejecting member after finishing is conducted. The exit tray includes a movable exit tray member on which the sheet is stacked, and a stationary exit tray member for supporting the movable exit tray member. The movable exit tray member has a sheet stacking surface on which the sheet is stacked, and a stopper portion provided adjacent to the sheet ejecting member to bring an edge of the sheet into contact with the stopper portion. The movable exit tray member is pivotally supported around a supporting shaft provided on a leading edge portion of the stationary exit tray member. An edge portion of the movable exit tray member, which is adjacent to the sheet ejecting means, can be moved upward or downward according to the number of sheets stacked on the movable exit tray.

9 Claims, 20 Drawing Sheets

FIG. 2 ( e )
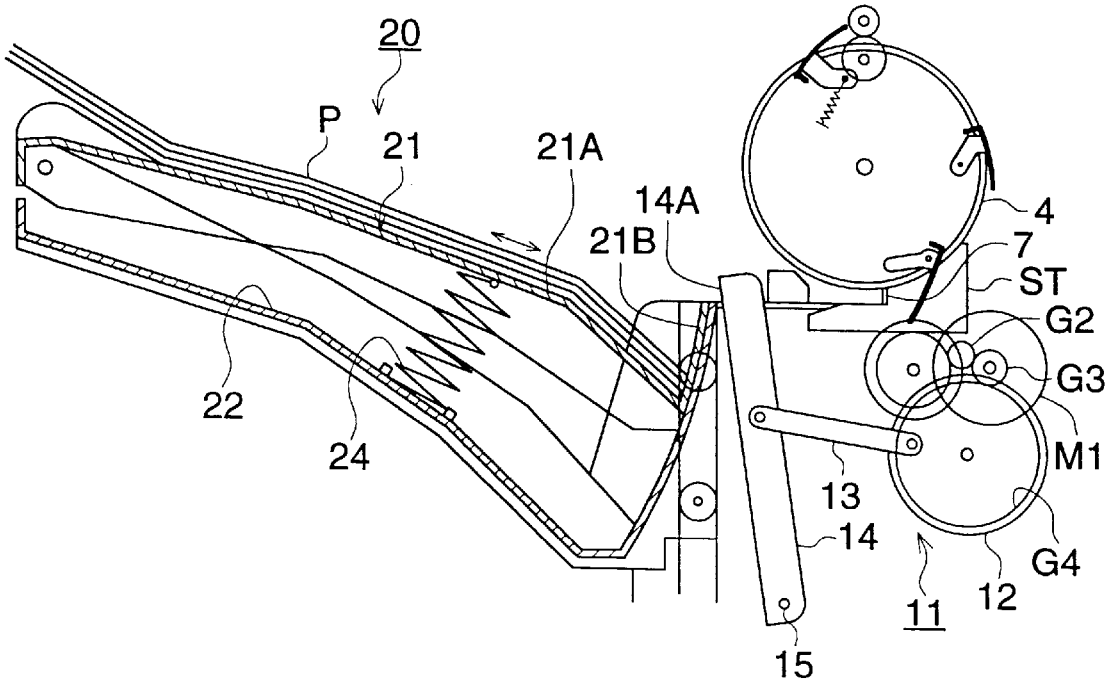
FIG. 2 ( f )
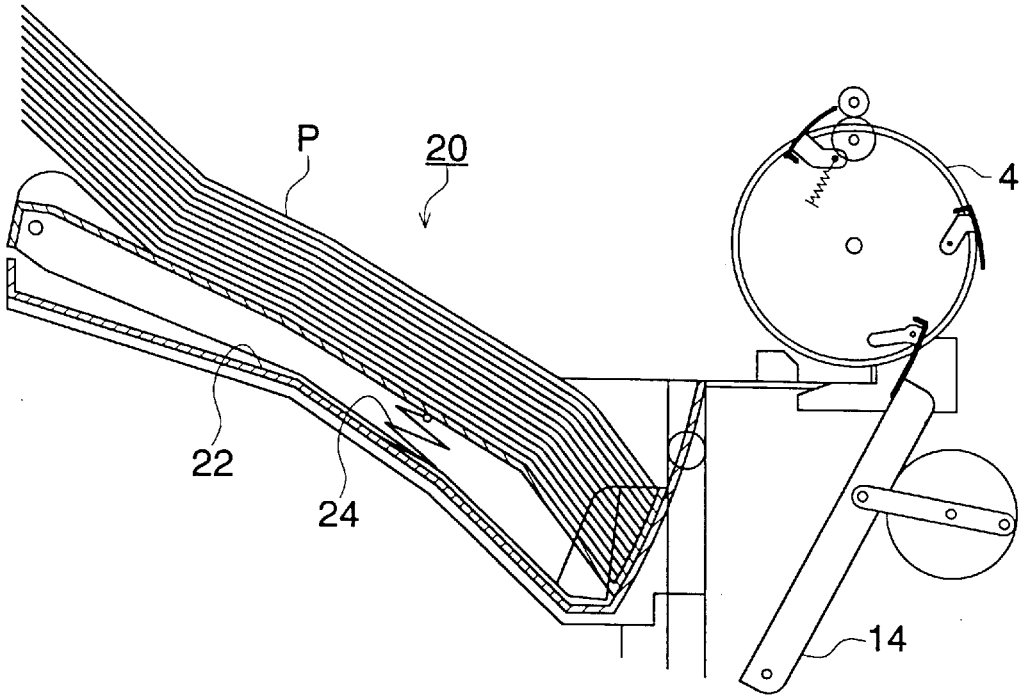

20
R
21
21A
21B
21C
21D
21E
22
22B
22C
22F
22G
23
24
25

SHEET FINISHING APPARATUS

BACKGROUND OF THE INVENTION

The present invention relates to a sheet finishing apparatus in which sheets, on which images are formed by an image forming apparatus such as an electrophotographic copier, a printer, a printing machine, or the like, are received, and finishing processings such as stapling by a stapler, shifting processing, and similar processing, are conducted, and then, the sheets are ejected onto an exit tray by a sheet ejecting means.

A sheet finishing apparatus, which is called a finisher, is used as an apparatus in which a plurality of sheets, on which images have been recorded and which are delivered from the image forming apparatus, are aligned for each copy volume and stapled by a stapler.

This finisher is connected to an image forming apparatus main body such as a copier, a printer, or a similar apparatus, in its function, and is driven corresponding to sequence operations of a copying, or printing process.

Accordingly, for an image forming apparatus by which a large number of sheets with images are processed at a high speed, a finisher is necessary which can follow the processing speed of the apparatus for achieving its functions, and by which a large number of sheets can be processed at a high a-rs speed.

Proposals for this type finisher in which high speed processing can be conducted, are disclosed in Japanese Patent Publication Open to Public Inspection Nos. 142359/1985, 158463/1985, 239169/1987, 288002/1987, 267667/1988, 276691/1990, and Japanese Patent Publication No. 41991/1993.

Sheets, on which images have been recorded, conveyed from the image forming apparatus main body, are sequentially stacked, being aligned, in an intermediate stacker. After sheets have been stacked for each one set of sheets, sheet finishing such as stapling, or the like, is conducted. The stapled set of sheets is put on a delivery belt provided in the bottom portion of the intermediate stacker and conveyed, held by a pair of upper and lower sheet delivery rollers, and delivered onto an exit tray.

A sheet finishing apparatus, described in Japanese Patent Application No. 42728/1996, (which matured into Japanese Patent Publication Open to Public Inspection No. 235069/1977), is provided with a stapler and an exit tray corresponding the stapler. A sheet finishing apparatus, described in Japanese Patent Publication Open to Public Inspection No. 76190/1995, is provided with 2 staplers and 2 exit trays corresponding to the staplers.

In a conventional sheet finishing apparatus, sheets, on which images are formed, conveyed from the image forming apparatus, are finishing processed by a sheet finishing processing means (staplers, shift means, bookbinding means, punching means, etc.), and after that, delivered onto an exit tray by a sheet ejecting means, slide down along an exit tray surface arranged being inclined, and trailing edge portions of the sheets come into contact with a stopper and stop. In this connection, a sheet, for which finishing is not necessary, is directly delivered onto fixed exit tray, slides down along the exit tray surface arranged being inclined, and the trailing edge portion of the sheet comes into contact with the stopper surface and stops.

Problems in the conventional sheet finishing apparatus will be listed below.

(1) As the number of sheets delivered and stacked on the exit tray means, on which sheets finishing processed by the sheet finishing apparatus are stacked, are increased, the height of the stacked sheets is increased. Accordingly, a sheet height detecting means is provided so that sheets do not interfere with a delivery path, and the exit tray means is controlled to be lowered so that the height of sheet stacking surface is constant. Accordingly, a control system and mechanism become complicated.

(2) When finishing processed sheets are delivered by the sheet ejecting means, and stacked on the sheet stacking surface of the exit tray means having an inclined surface in which the leading edge portion is higher, the leading edge portion of the large sized sheet projects and hangs down from the leading edge portion of the exit tray means, and further, is sliding-contacted with a succeeding delivery sheet and pushed out, resulting in possibility of sheet falling down from the sheet stacking surface of the exit tray means. When the sheet stacking surface is enlarged for preventing the sheet falling down, the size of the sheet finishing apparatus is increased, resulting in a problem in which the mounting space is increased.

(3) Also when no-finishing processed sheet is stacked on the stacking surface of the exit tray means (non-sort tray) of the sheet finishing apparatus, there is a problem of sheet falling down caused by hanging down of the leading edge portion of the sheet, and a problem in which the leading edge portion of the hanged down sheet contacts an elevating exit tray provided below it.

A sheet finishing apparatus disclosed in Japanese Patent Publication Open to Public Inspection No. 276691/1990, is structured in such a manner that 2 fur-brushes are rotatably provided and the leading edge portion of the fur-brush is in contact with a guide plate. A sheet finishing apparatus disclosed in the sheet accommodating apparatus in Japanese Patent Publication Open to Public Inspection No. 214565/1989, is structured in such a manner that a paddle wheel, on which a plurality of blade members are radially provided, is rotated for aligning the sheet. A sheet finishing apparatus disclosed in Japanese Patent Publication Open to Public Inspection No. 116168/1988, is structured in such a manner that a portion of a belt, whose lower end portion is in contact with an intermediate tray, is wound around a lower roller of a delivery roller pair, the belt is rotated with the lower roller, and causes the sheet conveyed on the intermediate tray to contact with a stopper.

A sheet finishing apparatus disclosed in Japanese Patent Publication Open to Public Inspection No. 127556/1989, has a first and a second sheet conveyance paths which convey sheets sent from the image forming means to the sheet finishing means, a conveyance direction switching means for switching the first and the second sheet conveyance paths, and a control means for controlling the conveyance direction switching means so that the sheet is sent to the second conveyance path corresponding to the operation of the sheet finishing apparatus.

The conventional sheet finishing apparatus has one exit tray which can go up and down, for one sheet finishing processing means (a stapler, a shift means, a bookbinding means, punching means, etc.). The exit tray has a fixed bottom surface on which sheets are stacked, and the overall exit tray is driven upward and downward by a driving source corresponding to the number of sheets stacked on the fixed bottom surface of the exit tray. Accordingly, the maximum number of sheets accommodated on one exit tray is limited.

Further, when sheets outputted in different image forming modes, (for example, sheets outputted in a copy mode, and sheets outputted in a printer mode), are successively delivered onto the exit tray after respectively finishing processed, sheets in both modes are mixed on the exit tray, and a problem occurs in which sheet sorting is difficult.

Furthermore, when sheets processed in different finishing processing modes, (for example, stapling processed sheets, and shifting processed sheets ), are successively delivered on the exit tray, sheets in both modes are mixed on the exit tray, resulting in a problem of difficult sheet sorting.

SUMMARY OF THE INVENTION

The first object of the present invention is to solve the above problems and to provide a sheet finishing apparatus in which the trailing edge of the sheet stacked on a movable tray of the exit tray means, is smoothly lowered by its own weight, so that the sheet ejection failure is prevented and the control mechanism is simplified.

The second object of the present invention is to provide a sheet finishing apparatus in which a large number of finishing processed sheet sets can be accommodated on the exit tray.

The other object of the present invention is to provide a sheet finishing apparatus in which (a) the leading edge of the large sized sheet stacked on the sheet stacking surface does not hang down, so that the exit tray means, whose size is reduced, is provided; (b) the large sized sheet which is not finishing processed, can be stacked on the non-sort tray whose size is reduced; (c) after the sheets outputted in different image formation modes have been finishing processed, the sheet can be sorted and accommodated; and (d) sheet sets finishing processed in different sheet finishing modes can be sorted and accommodated.

The above object is attained by a sheet finishing apparatus for finishing a sheet, on which an image has been —formed, conveyed from an image forming apparatus, the sheet finishing apparatus comprising: a sheet ejecting means for ejecting the sheet after finishing; and an exit tray for receiving the sheet ejected by the sheet ejecting means after finishing is conducted. The exit tray includes a movable exit tray member on which the sheet is stacked, and a stationary exit tray member for supporting the movable exit tray member, wherein the movable exit tray member has a sheet stacking surface on which the sheet is stacked, and a stopper portion provided adjacent to the sheet ejecting means to bring an edge of the sheet into contact with the stopper portion, the movable exit tray member is pivotally supported around a supporting shaft provided on a leading edge portion of the stationary exit tray member, and wherein an edge portion of the movable exit tray member, which is adjacent to the sheet ejecting means, can be moved upward or downward according to the number of sheets stacked on the movable exit tray.

DETAILED DESCRIPTION OF THE PREFERRED EMBODIMENTS

Referring to the attached drawings, examples of a sheet finishing apparatus to attain the first object of the present invention will be described below,.

Figure 1:
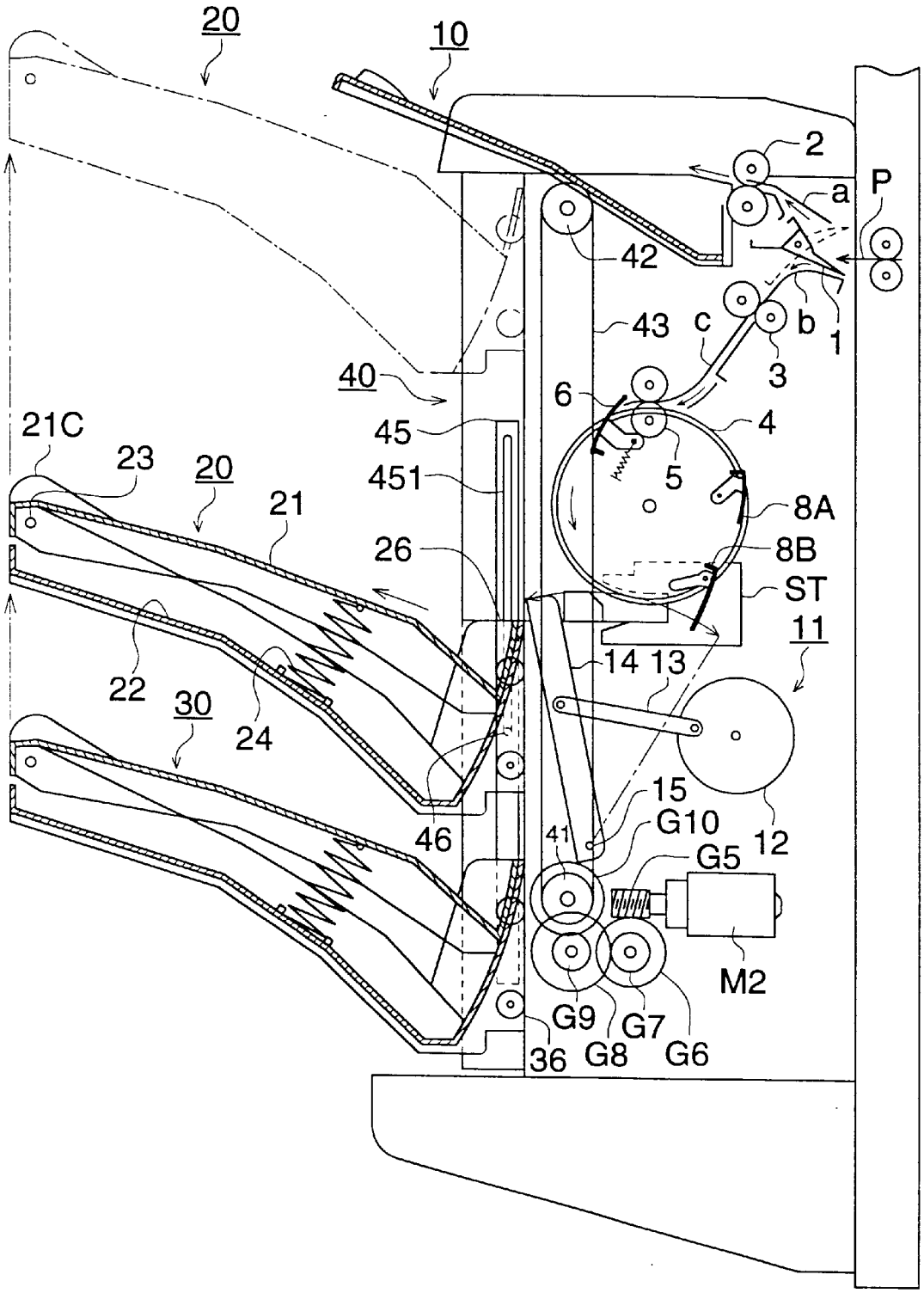
FIG. 1 is a sectional view showing the structure of a sheet finishing apparatus of the present invention.

FIG. 1 is a sectional view showing the structure of the sheet finishing apparatus (finisher).

The position and height of the sheet finishing apparatus are adjusted for mounting in such a manner that a receiving portion for a sheet P coincides with a delivery sheet port of an image forming apparatus (copier, printer, etc.) main body, and the apparatus is connected to a control system so that it is driven corresponding to operations of the image forming apparatus main body.

The conveyance path of the sheet P introduced in the receiving portion is switched to a upper conveyance path a and to a lower conveyance path b by oscillation switching of a switching gate (branching plate) 1.

The sheet P delivered from the image forming apparatus main body passes through the upper conveyance path a by switching of the switching gate 1 of the receiving portion, the sheet P is held by an ejecting roller pair 2, and is delivered on an exit sheet tray 10, fixedly placed at the uppermost portion of the sheet finishing apparatus.

On the other hand, the sheet P, passed through the lower conveyance path b by switching of the switching gate 1 (shown by a dotted line) of the receiving portion, is held and conveyed by an intermediate conveyance roller pair 3, composed of a driving roller and a pinch roller, passes through a conveyance path c formed by a fixed guide plate, held by a conveyance roller pair 5 located above a sheet reverse conveyance drum 4, and is conveyed on the peripheral surface of the sheet reverse conveyance drum 4. The sheet reverse conveyance drum 4 is rotated by a driving source, not shown, in the arrowed direction. A sheet pressing member (gripper) 6 is pivotally supported near the peripheral surface of the sheet reverse conveyance drum 4. The sheet pressing member 6 is pushed by a spring and oscillated by a cam mechanism, not shown.

The leading edge portion of the sheet P sent from the nipping position of the conveyance roller pair 5 to the peripheral surface of the sheet reverse conveyance drum 4, comes into a V-shaped gap portion, formed between the leading edge portion of the sheet pressing member 6 and the peripheral surface of the reverse conveyance drum 4, which is opened by the cam mechanism. The sheet P is brought into pressure contact with and held by the peripheral surface of the rotating sheet reverse conveyance drum 4 and the leading edge portion of the sheet pressing member 6 which is pushed by a spring, and is conveyed on the peripheral surface of the sheet reverse conveyance drum 4. In this connection, the peripheral speed of the conveyance roller pair 5 and that of the sheet reverse conveyance drum 4 are equal during sheet conveyance.

Figure 2:
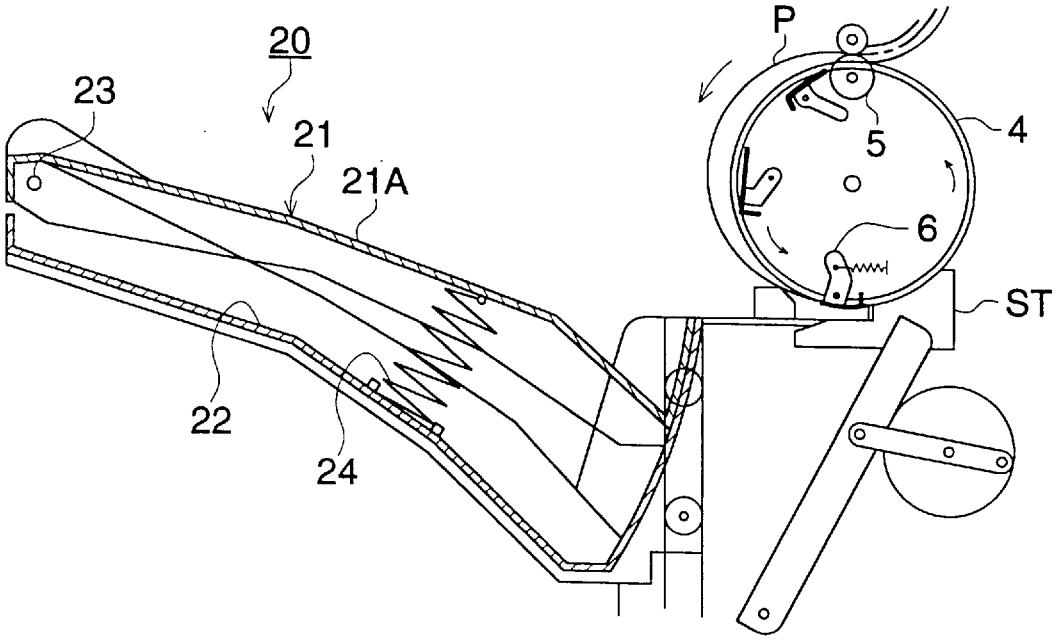
FIGS. 2(*a*) to 2(*f*) are partial sectional views showing sheet conveyance processes of the sheet finishing apparatus.
Figure 2:
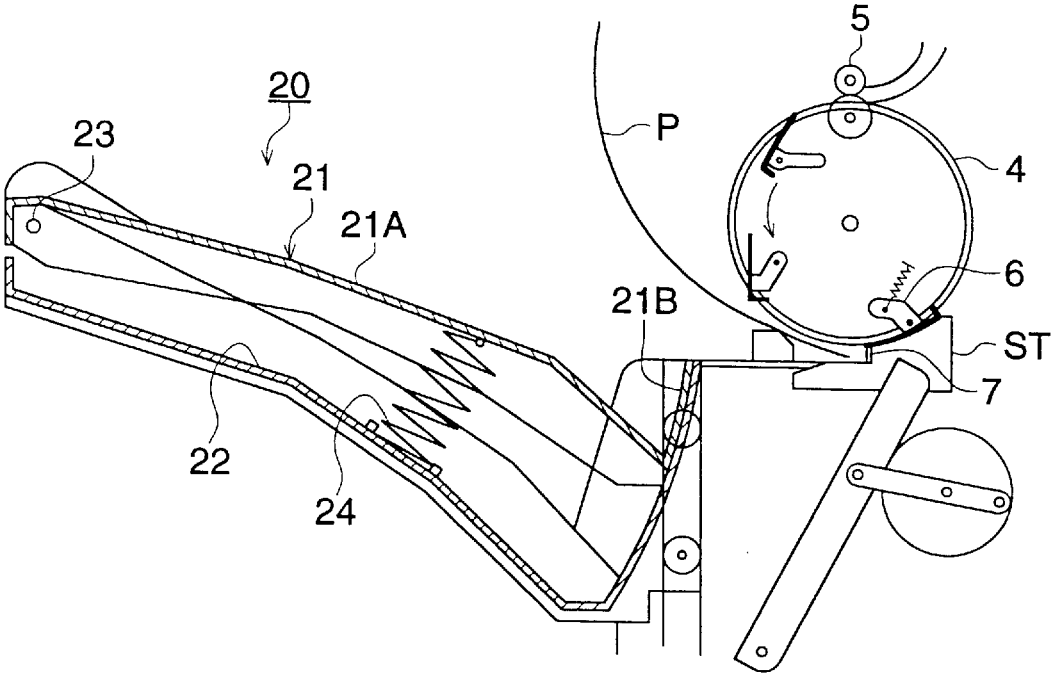
Figure 2:
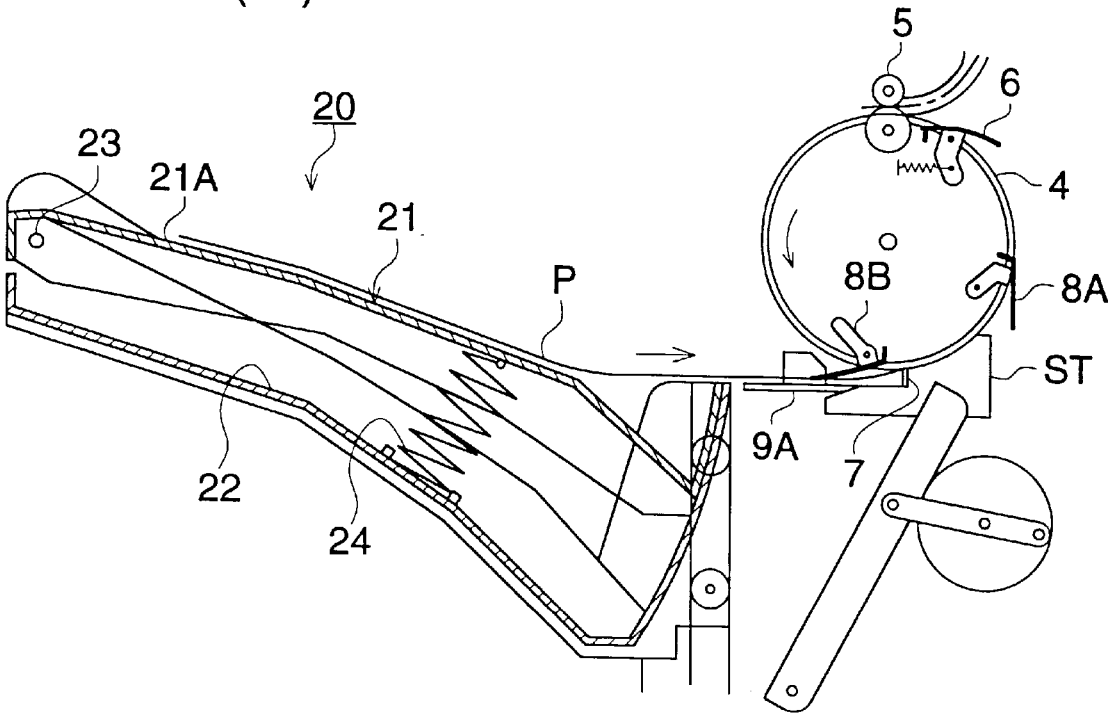
Figure 2:
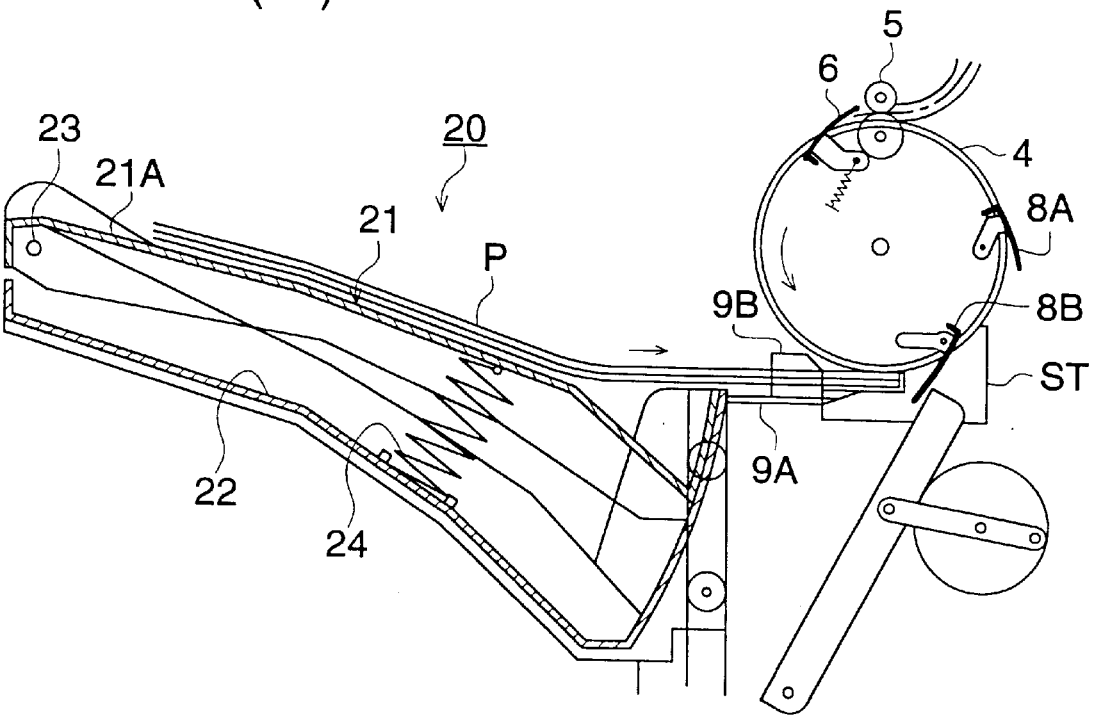

FIGS. 2(*a*) to 2(*f*) are partial sectional views showing sheet conveyance processes of the sheet finishing apparatus.

In FIG. 2(*a*), when the speed of the conveyance roller pair 5 is increased while the leading edge portion of the sheet P is brought into pressure contact with and held by the leading edge portion of the sheet pressing member 6 pushed by a spring, and is conveyed, on the peripheral surface of the rotating sheet reverse conveyance drum 4, the leading edge portion of the sheet P is held by the sheet pressing member 6, however, the speed of a portion near the trailing edge portion of the sheet P is increased by the conveyance roller pair 5, and the sheet P is excessively sent out, thereby the intermediate portion of the sheet P is separated from the peripheral surface of the sheet reverse conveyance drum 4, and swells outward.

In FIG. 2(*b*), when the sheet reverse conveyance drum 4 continues to be rotated further, the sheet P is reversed by the conveyance force of the conveyance roller pair 5 and the rigidity of the sheet P at an instant when the trailing edge portion of the sheet P is separated from the nipping position of the conveyance roller pair 5, and thereby, the sheet P is separated from the peripheral surface of the sheet reverse conveyance drum 4. When the leading edge portion of the sheet P reaches the stopper 7 and comes into contact with it, and stops, the sheet pressing member 6 is separated from the sheet P.

When the sheet reverse conveyance drum 4 further continues to be rotated, 2 she et arranging members 8A and 8B rotatably supported at 2 portions in the sheet reverse conveyance drum 4, successively sliding contact with near the leading edge portion of the sheet P, the leading edge portion of the sheet P is brought into contact with the stopper 7 and stops, and the sheet P is arranged in the direction of conveyance, as shown in FIG. 2(*c*). The leading edge portion of the arranged sheet P is placed on the intermediate ejection sheet tray 9A, and the trailing edge portion of the sheet P is placed on a movable exit tray 21 and a fixed exit tray 22 of a ejection sheet tray means 20.

In a process shown in FIG. 2(*d*), in which the leading edge portion of the sheet P is brought into contact with the stopper 7, the alignment plate of the shift alignment means 9B arranges (alignment in width) the sheet P in the direction of width (the direction perpendicular to the sheet conveyance direction). Alternatively, when the operation mode is set to the shift mode, the alignment plate is successively shifted to predetermined plural positions, and the alignment is conducted in the direction of width. After the sheet reverse conveyance drum 4 is rotated once and positioning of the first sheet P has been completed, the second sheet P is sent to the sheet reverse conveyance drum 4, conveyed in the same manner as described above, positioned and stops. As described above, when the number of sheets P, which is brought into contact with the stopper 7 and positioned, reaches a predetermined number, the sheets P are stapled at a predetermined position by a stapler ST and bound together. In this connection, when the operation mode is set to the shift mode, the shift operation is conducted by the alignment plate.

FIG. 2(*e*) shows a condition in which the sheets P, for which sheet finishing such as stapling, shifting, etc., has been completed, are ejected onto the movable exit tray member (hereinafter, called the movable exit tray) 21 and the fixed exit member (hereinafter, called the fixed exit tray) 22.

A driving motor M1 of the sheet ejecting means 11 drives a disk 12 through a gear train composed of gears GI, G2, G3, and G4. The other end of a crank 13, whose one end is supported at an eccentric position of the disk 12, is pivotally supported rotatably by a portion of an ejecting arm 14 which can oscillate around a fulcrum shaft 15. The disk 12 driven by the driving source, eccentrically moves the crank 13, and further oscillates the ejecting arm 14. By this oscillation movement of the ejecting arm 14, the leading edge portion 14A of the ejecting arm 14 presses the leading edge portion of the sheet P for which sheet finishing has been completed, and pushes out the sheet P from the contact position with the stopper 7 to the movable exit tray 21 and the fixed exit tray 22 of the exit tray means 20. The sheet P pushed out by the ejecting arm 14 slides on the upper surface of the movable exit tray 21 and the fixed exit tray 22, then, the leading edge portion of the sheet P is lowered by its own weight, and comes into contact with the stopper surface portion 21B of the movable exit tray 21, and stops. The leading edge portion 14A of the ejecting arm 14 advances to a near portion above the stopper surface portion 21B of the movable exit tray 21 in the vertical direction, and thereby the set of sheets does not remain in the finishing section and is securely moved onto the sheet stacking surface 21A of the exit tray means 20.

Figure 3:
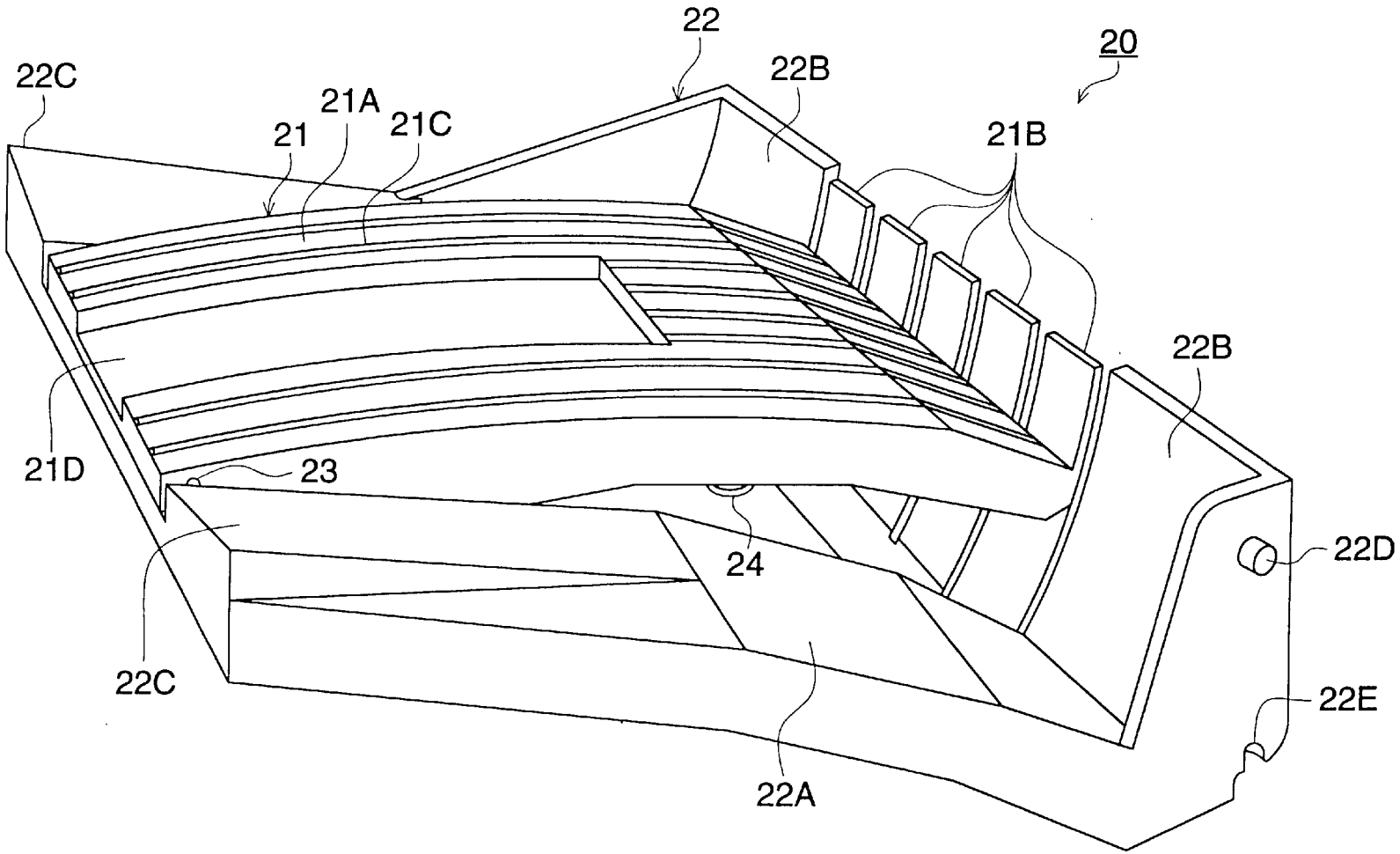
FIG. 3 is a perspective view of an exit tray means.
Figure 4:
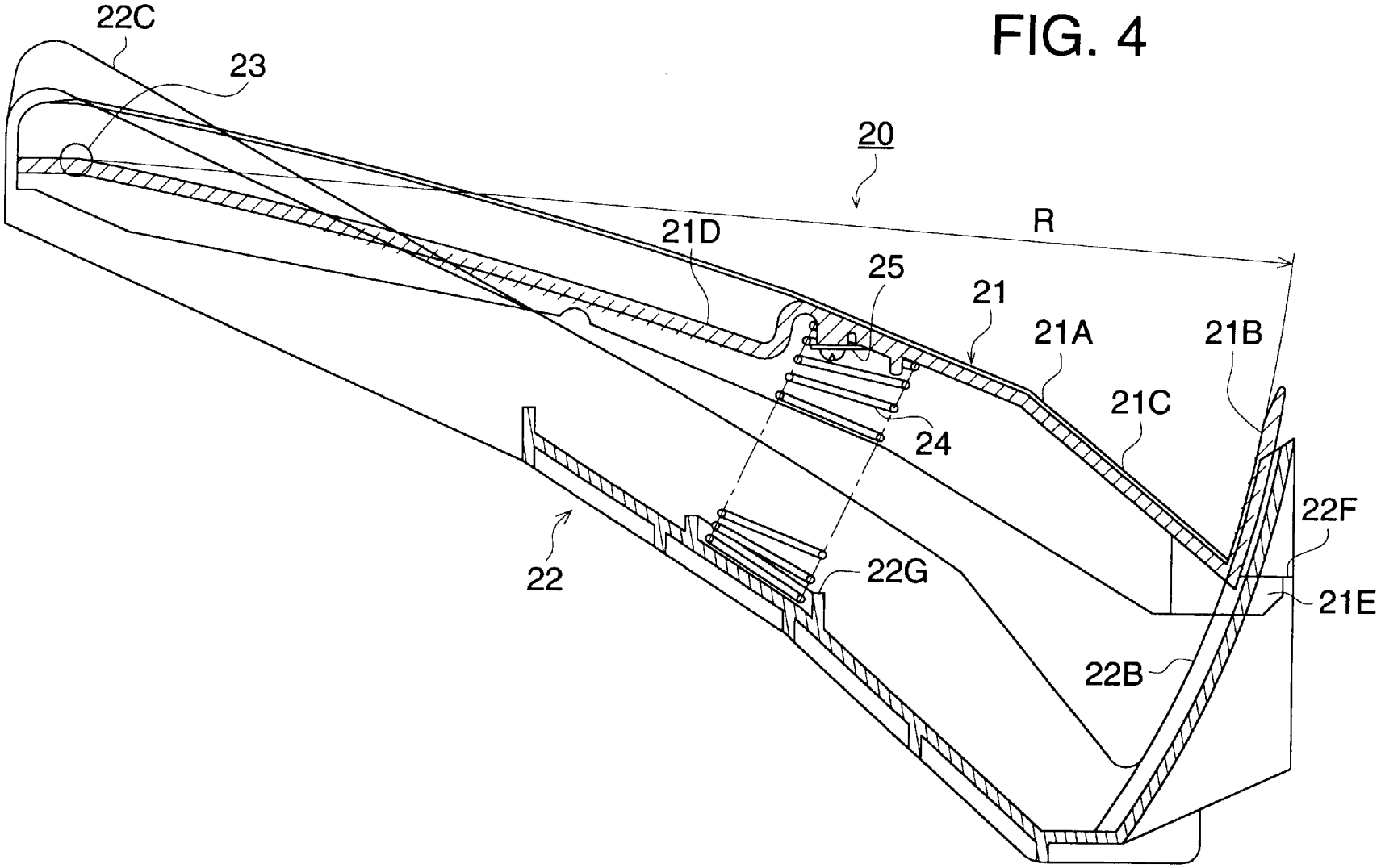
FIG. 4 is a sectional view of the exit tray means.

FIG. 3 is a perspective view of the exit tray means. FIG. 4 is a sectional view of the exit tray means. In this connection, the upper exit tray means 20 and the lower exit tray means 30 have the same shape, and therefore, the upper exit tray means 20 will be explained as a representative hereinafter.

The exit tray means 20 comprises the fixed exit tray 22, movable exit tray 21, support shaft 23 which oscillatably supports one end of the movable exit tray 21 at the fixed exit tray 22, and a spring member 24 which pushes upward the other end of the movable exit tray 21.

The sheet stacking surface 22A of the fixed exit tray 22 is formed into an inclined plane on which the leading edge portion of the stacked sheet is high, and the trailing edge portion is low. A curved auxiliary stopper surface portion 22B is integrally formed on the side of lower portion of the inclined plane.

Protruded portions 22C which are higher than near the central portion in the direction of width, are formed at near both ends of the leading edge portion of the fixed exit tray 22, that is, near both ends in the direction of width, perpendicular to the direction of sheet ejection, of the stacking surface on which near the leading edge portion of the sheet is stacked.

The fixed exit tray 22 is engaged and fixed on the elevation means of the sheet finishing apparatus main body by a protruded engagement portion 22D and a recessed groove-like engagement portion 22E, and is driven upward or downward.

The sheet stacking surface 21A of the movable exit tray 21 is positioned at a middle portion of the sheet stacking surfaces 22A provided on both sides of the fixed exit tray 22, and has a plurality of protruded stripes (rib) 21C which slidingly contact with the sheet surface, and a recessed portion 21D for taking out the sheet.

A base portion of the stopper surface portion 21B is connected to an end portion of the sheet stacking surface 21A and integrated, on the side of end surface which is connected to the sheet stacking surface 21A of the movable exit tray 21, that is, on the side on which the trailing edge portion of the stacked sheet is positioned. This stopper surface portion 21B is formed into a cylindrical surface of the radius R in which the center line of the support shaft 23 is used as a central axis. Numeral 21E is an upper limit stopper which is provided below the stopper surface portion 21B of the movable exit tray 21, and is in contact with an engagement surface 22F provided near the auxiliary stopper surface portion 22B of the fixed exit tray 22, and stops the movable exit tray 21 at an upper limit position.

The sheet ejected outside the apparatus by the sheet ejecting means 11, is delivered on the sheet stacking surface 21A, and after that, the sheet slides down on the sheet stacking surface 21A by its weight, and the trailing edge portion of the sheet advances toward the stopper surface portion 21B.

The upper end of the spring member 24 is positioned on the bottom portion of the movable exit tray 21 and is fixed by an engagement member 25. The lower end of the spring member 24 is freely engaged in a recessed portion 22G provided on the bottom portion of the fixed exit tray 22, and is positioned.

Figure 5:
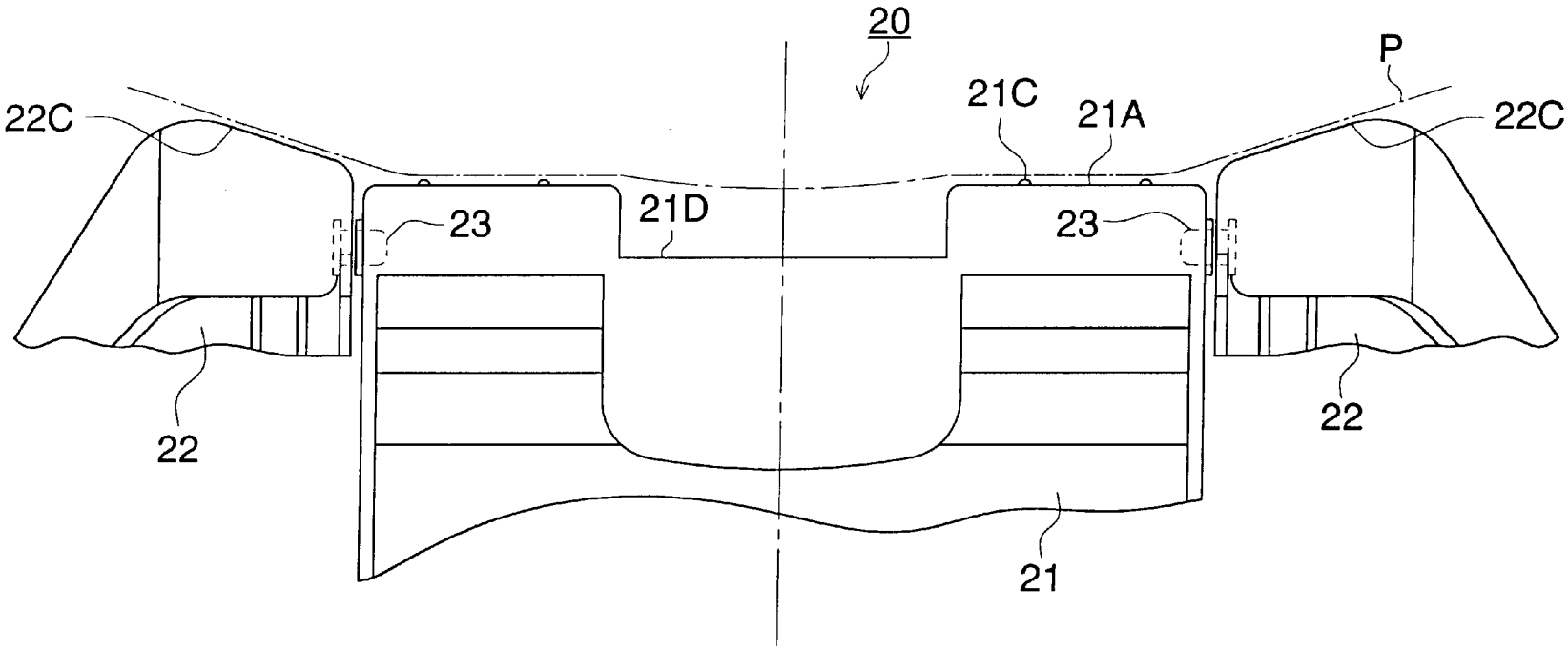
FIG. 5 is a side view of the exit tray means.

FIG. 5 is a side view of the exit tray means. Both end portions of the large sized sheet P in the direction perpendicular to the direction of sheet ejection are curved upward by the protrusions 22C protruded on both sides of the fixed exit tray 22, wherein the large sized sheet P is stacked on the sheet stacking surface 21A of the movable exit tray 21 and also on the sheet stacking surface 22A of the fixed exit tray 22. In this manner, even when the sheet P, whose leading edge portion including near the portion is curved in the direction perpendicular to the direction of sheet ejection, projects further forward from the leading edge portions of the movable exit tray 21 and the fixed exit tray 22, the leading edge portion of the sheet P does not hang down. Accordingly, the length of each sheet stacking surface of the movable exit tray 21 and fixed exit tray 22 can be reduced less than the length of the large sized sheet P in the ejecting direction, thereby the size of the exit tray means, which projects from the sheet finishing apparatus main body and goes upward or downward, can be reduced.

Figure 6:
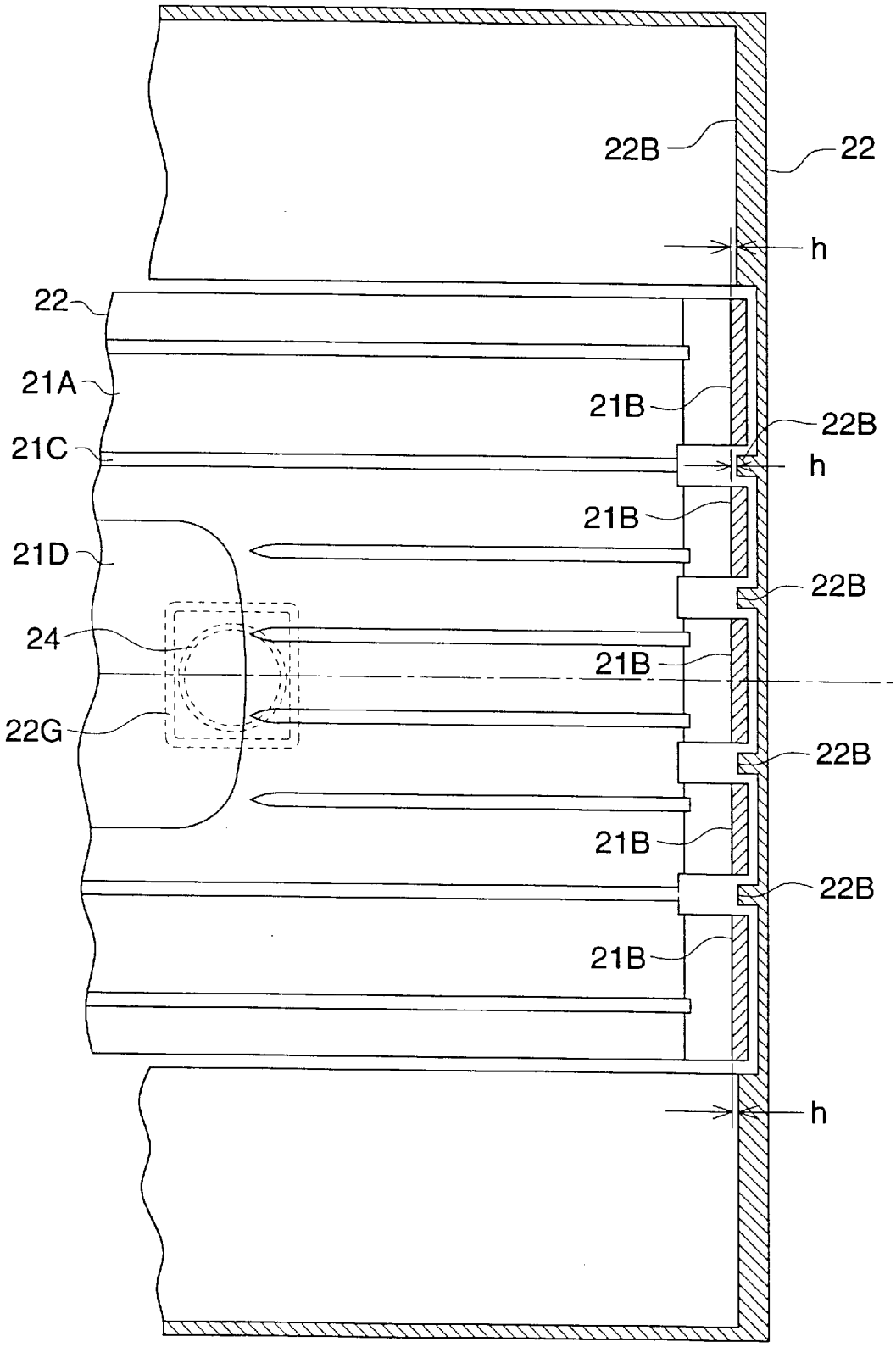
FIG. 6 is a partial plan view of the exit tray means.

FIG. 6 is a partial plan view of the exit tray means. The stopper surface portion 21B of the movable exit tray 21 projects from the auxiliary stopper surface portion 22B of the fixed exit tray 22. The projected step increment h is about 1 mm. The auxiliary stopper surface portion 22B is formed into the cylinder surface of the radius of (R+h) in which the center line of the support shaft 23 is the central axis.

The leading edge portion of the sheet P, which is ejected onto the exit tray means and slides down on the movable exit tray 21 and the fixed exit tray 22, comes into contact with the stopper surface portion 21B of the movable exit tray 21, stops, and is arranged.

Figure 7:
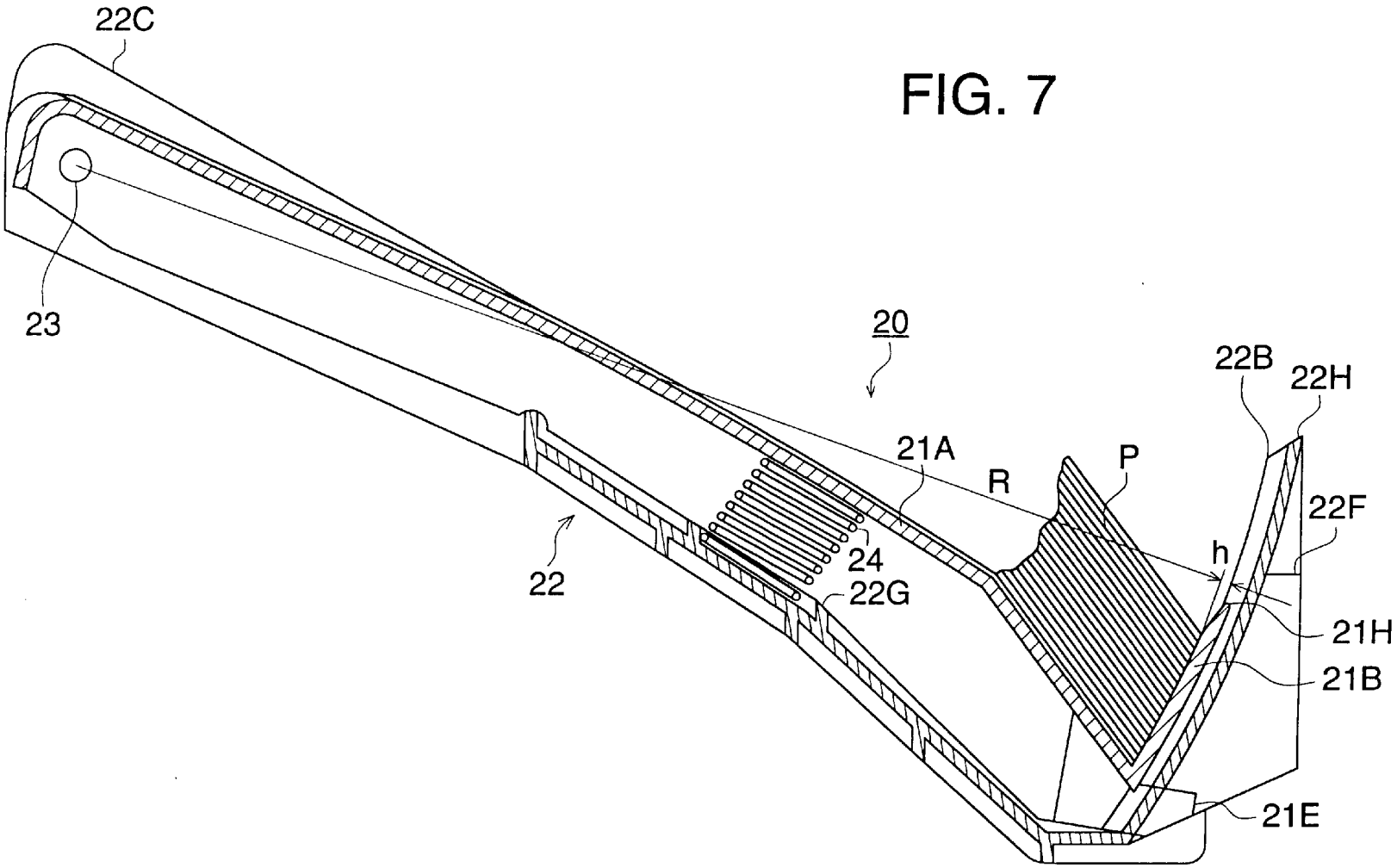
FIG. 7 is a sectional view showing a condition that a movable exit tray of the exit tray means is lowered.

FIG. 7 is a sectional view showing a condition that the movable exit tray 21 of the exit tray means 20 is lowered. When a large number of sheets P are stacked on the exit tray means 20 and its weight is more than a predetermined value, the movable exit tray 21 is lowered against the pushing force of the spring member 24 by the weight of the sheets P. A stopper top portion 21H of the movable exit tray 21 is positioned at almost equal position to or slightly higher position than an auxiliary stopper top portion 22H of the fixed exit tray 22, and the trailing edge portion of the stacked sheet P comes into contact with the stopper surface portion 21B of the movable exit tray 21, and stops.

Even when the sheet P is stacked on the movable exit tray 21 and the tray is lowered, the leading edge portion of the sheet P comes into contact with the stopper surface portion 21B, stops, and is arranged. In the above sheet stacking process, the leading edge portion of the sheet P comes into contact with the stopper surface portion 21B of the movable exit tray 21 which can go up and down, and is arranged. Thereby, the frictional resistance is not added to the leading edge portion of the sheet P, and the movable exit tray 21 is smoothly lowered.

When the sheet P is further stacked on the sheet stacking surface 21A and the height of the stacked sheets is over the stopper top portion 21H, the leading edge portion of the sheet P comes into contact with the auxiliary stopper surface portion 22B of the fixed exit tray 22, and stops.

When the sensor detects that the finishing processed sheet P which is stacked on the movable exit tray 21 of the upper exit tray means 20, reaches the upper limit of the stacking volume, and the signal is generated, the control section, not shown, drives the driving motor M2 for tray elevation of the elevation driving means 40, and the upper exit tray means 20 is elevated. That is, the gear train composed of gears G5, G6, G7, G8, G9, G10 drives a drive pulley 41 by the drive of driving motor M2. A drive wire 43 is wound around the drive pulley 41 and an upper driven pulley 42. By the rotation of the drive pulley 41, the drive wire 43 is vertically reciprocated.

On a portion of the drive wire 43, the base portion of the frame of the upper exit tray means 20 is fixed by a delivery sheet tray hanging metal fittings. The frame 26 of the upper exit tray means 20 and the frame 36 of the lower exit tray means 30 are connected by a connecting rod 45. That is, a long groove portion 451 is provided in the connecting rod 45, and a pin 46 fixedly provided on the frame 26 of the upper exit tray means 20 slidingly contacts with the groove 451 (refer to FIG. 1). A near portion of the lower end portion of the connecting rod 45 is fixed on the frame 36 of the lower exit tray means 30.

When the upper delivery sheet tray means 20 is moved upward by the drive wire 43, the pin 46 (refer to FIG. 1), fixedly provided on the frame 36 of the upper exit tray means 20, sliding-contacts with the long groove portion 451 of the connecting rod 45, and only the upper exit tray means 20 is moved upward. When the pin 46 contacts the uppermost end of the long groove portion 451 of the connecting rod 45, the distance between the moved upper exit tray means 20 and the stopped lower exit tray means 30 is maximum.

When the upper exit tray means 20 is further moved upward by the drive wire 43, the pin 46 of the upper exit tray means 20 moves the connecting rod 45 upward under the condition that the pin 46 is in contact with the long groove portion 451, thereby, the lower exit tray means 30 which is fixed on the lower end of the connecting rod 45, is lifted and moved.

Accordingly, the upper exit tray means 20 and the lower exit tray means 30 are integrally moved upward with the above-described maximum distance between them.

Figure 8:
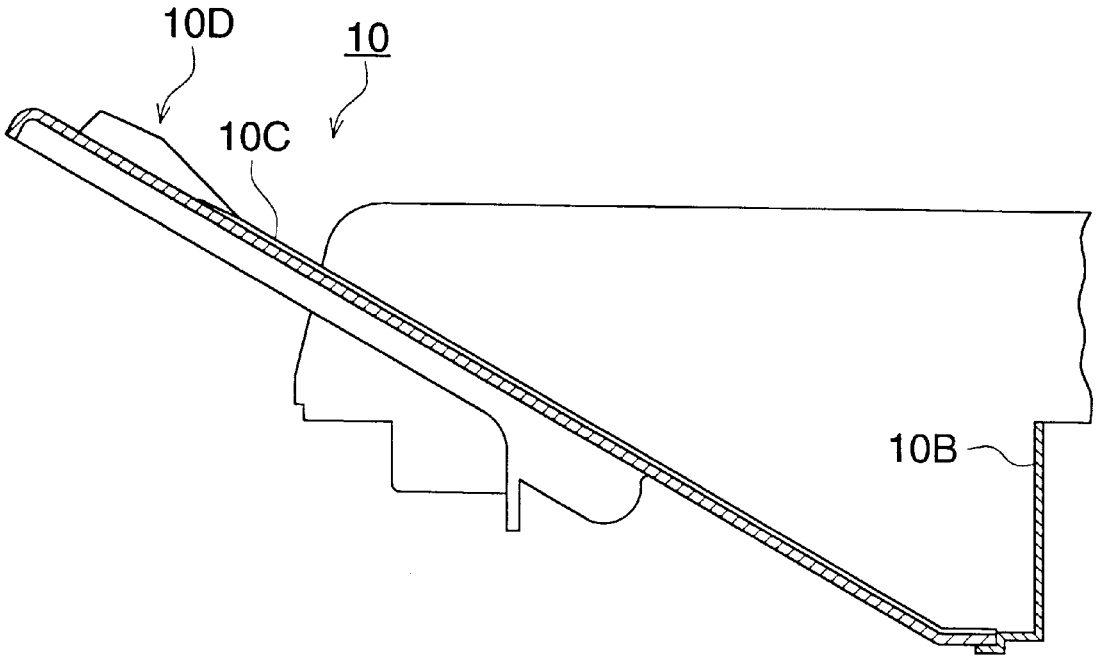
FIG. 8 is a sectional view of the uppermost exit tray.
Figure 9:
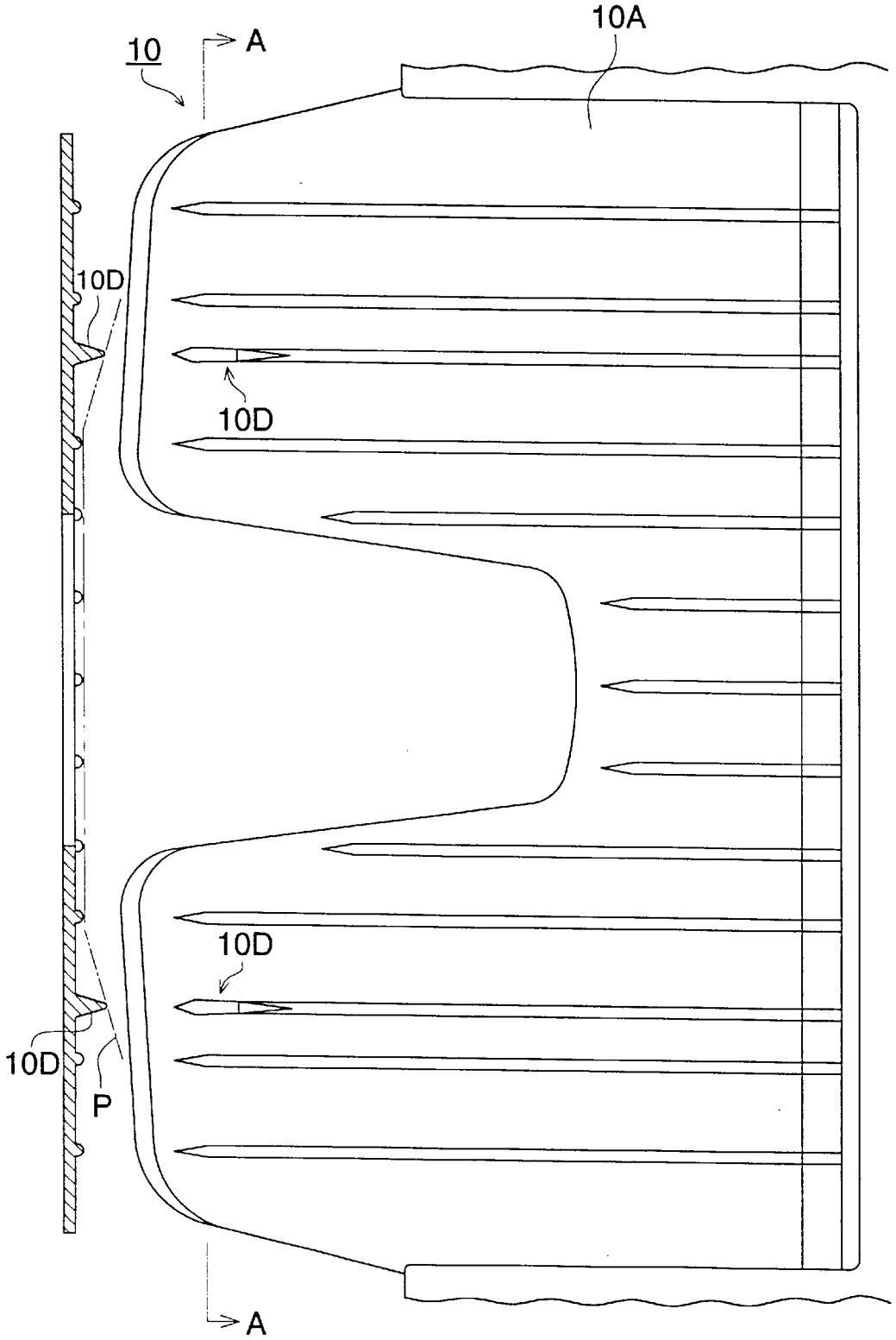
FIGS. 9(*a*) and 9(*b*) are a plan view and a sectional view taken on line A—A in FIG. 9(*a*), of the uppermost exit tray.

FIG. 8 is a sectional view of the uppermost exit tray 10. FIG. 9(*a*) is a plan view of the exit tray 10, and FIG. 9(*b*) is a sectional view of the exit tray 10 taken on line A—A in FIG. 9(*a*).

The uppermost exit tray 10 serves also as a top plate of the sheet finishing apparatus, and the sheet on which finishing such as stapling, or the like, is not conducted, is directly stacked and accommodated on the tray.

The exit tray 10 has an inclined sheet stacking surface A, an almost vertical stopper surface portion 10B, and a plurality of protruded stripes (ribs) 10C formed on the sheet stacking surface 10A. In the leading edge portion of the sheet stacking surface 10A in the direction of sheet ejection, the protruded portion 10D is protruded higher than protruded stripes 10C in the direction perpendicular to the sheet ejecting direction.

The leading edge portion of the sheet P ejected on the exit tray 10 is curved upward as shown in FIG. 9(*b*), and stacked on the sheet stacking surface 10A. Like this, even when the sheet P whose leading edge portion including its near portion is curved in the direction perpendicular to the sheet ejecting direction, further projects forward from the sheet stacking surface 10A of the exit tray 10 and overhangs, the leading edge portion of the sheet P does not hang down. Accordingly, the length of the sheet stacking surface 10A of the exit tray 10 can be reduced less than the length of the large sized sheet P in the ejecting direction. Thereby, as shown in FIG. 1, even when the exit tray means 20 which moves upward or downward, is elevated to the uppermost position, overlap of the uppermost exit tray 10 with the upper exit tray means 20 in the vertical direction is small, and therefore, the finished sheet P can be easily taken out from the upper exit tray means 20.

In this connection, in the example of the present invention, the sheet finishing apparatus connected to the copier was shown, however, the present invention can also be applied to a sheet finishing apparatus connected to an image forming apparatus such as a printer, a facsimile device, etc., or a light printing machine, or similar device.

According to the sheet finishing apparatus of the present invention, the following excellent effects can be obtained.

(1) During sheet stacking, the trailing edge portion of the sheet does not slide-contact with the stationary exit tray member until a height of sheets stacked on the sheet stacking surface reaches the top of the stopper surface portion of the movable exit tray, thereby, the movable exit tray is smoothly lowered, a collision of the trailing edge portion of the sheet with the leading edge portion of the succeeding sheet due to the rise of the trailing edge portion of the sheet can be avoided, and the ejection failure can be prevented.

(2) When protrusions are provided on the both ends of the fixed exit tray so that the leading edge portion of the sheet is curved, the large sized sheet can be stacked on the small sized exit tray which has a small sheet stacking surface.

(3) In also the case where the sheet which is not finishing processed, is stacked on the sheet stacking surface of the exit tray means (non-sort tray) of the sheet finishing apparatus, in the same manner, when protrusions are provided on the both ends of the exit tray so that the leading edge portion of the sheet is curved, the large sized sheet can be stacked on the small sized exit tray which has a small sheet stacking surface. Further, there is no possibility that the leading edge of the large sized sheet hangs down, and interferes with the lower movable exit tray.

Next, in order to attain the second object, another example of the sheet finishing apparatus of the present invention will be described, referring to the attached drawings.

Figure 10:
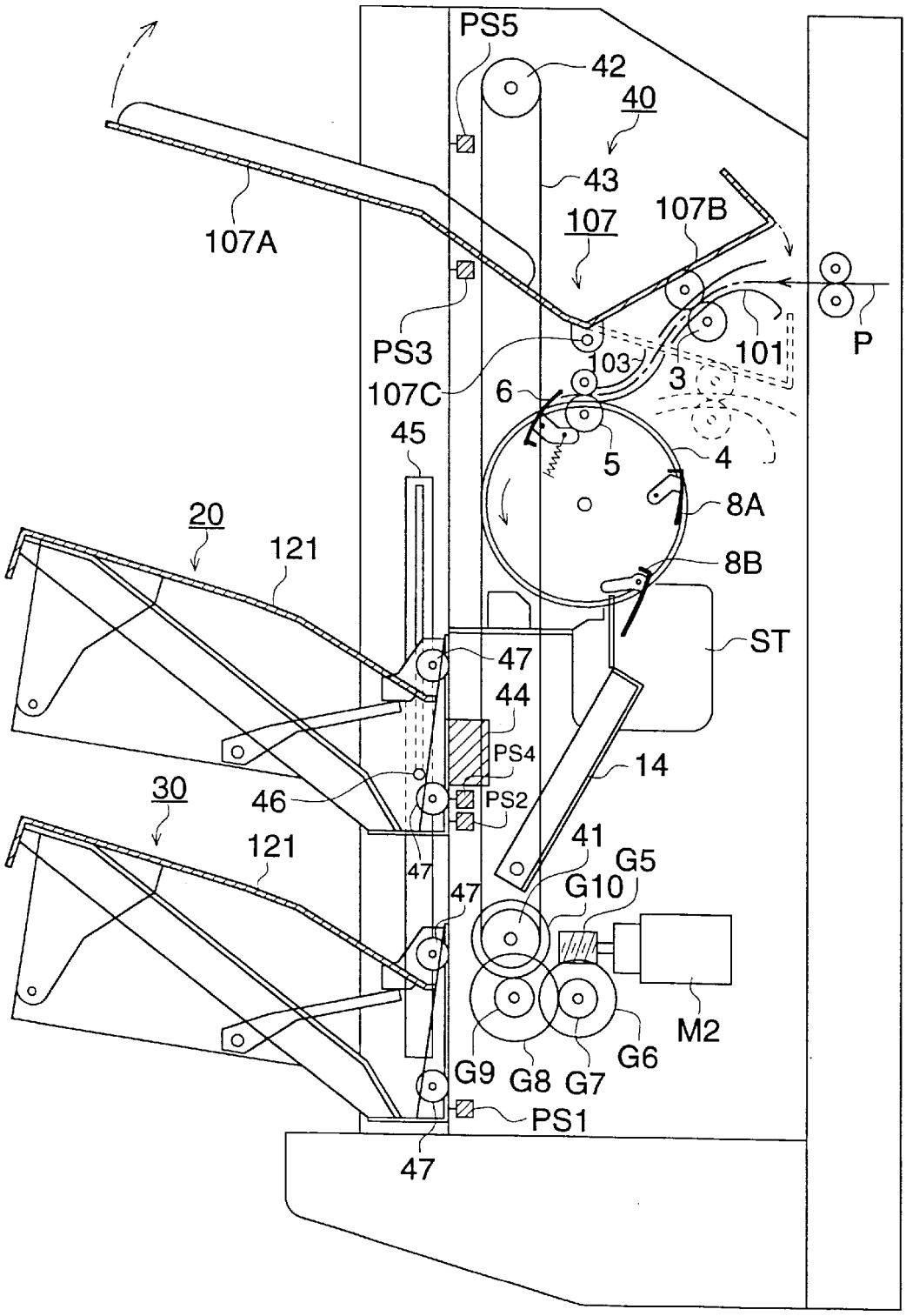
FIG. 10 is a sectional view showing the structure of the sheet finishing apparatus of the present invention.

FIG. 10 is a sectional view showing the structure of the sheet finishing apparatus (finisher). The position and height of the sheet finishing apparatus are adjusted for mounting in such a manner that a receiving portion for a sheet P coincides with a delivery sheet port of an image forming apparatus (copier, printer, etc.) main body, and the apparatus is connected to a control system so that it is driven corresponding to operations of the image forming apparatus main body.

The sheet P, introduced into a movable guide plate 101 of the receiving portion, is held and conveyed by the conveyance roller pair 3, composed of the driving roller and the pinch roller, passes through a fixed guide plate 103, held by a conveyance roller pair 5 located above a sheet reverse conveyance drum 4, and is conveyed on the peripheral surface of the sheet reverse conveyance drum 4. The sheet reverse conveyance drum 4 is rotated by a driving source, not shown. A sheet pressing member (gripper) 6 is pivotally supported near the peripheral surface of the sheet reverse conveyance drum 4. The sheet pressing member 6 is pushed by a spring and oscillated by a cam mechanism, not shown.

The leading edge portion of the sheet P sent from the nipping position of the conveyance roller pair 5 to the peripheral surface of the sheet reverse conveyance drum 4, comes into a V-shaped gap portion, formed between the leading edge portion of the sheet pressing member 6 and the peripheral surface of the reverse conveyance drum 4, which is opened by the cam mechanism. The sheet P is brought into pressure contact with and held by the peripheral surface of the rotating sheet reverse conveyance drum 4 and the leading edge portion of the sheet pressing member 6 which is pushed by a spring, and is conveyed on the peripheral surface of the sheet reverse conveyance drum 4. In this connection, the peripheral speed of the conveyance roller pair 5 and that of the sheet reverse conveyance drum 4 are equal during sheet conveyance.

The uppermost delivery sheet means (non-sort tray) 107 is provided above the movable guide plate 101 and the conveyance roller pair 3. The uppermost exit tray 107 is composed of a left exit tray 107A and a right exit tray 107B, as shown in the drawing, in which a fulcrum shaft 107C serves as a center, and these exit trays 107A and 107B can be oscillated around the fulcrum shaft 107C as an oscillation center, in the arrowed direction by one dotted chain line. The exit tray 107B is formed into a unit with the movable guide plate 101 and the conveyance roller pair 3, and therefore when the exit tray 107B is oscillated, the movable guide plate 101 and the conveyance roller pair 3 are also integrally oscillated. The movable guide plate 101, the conveyance roller pair 3 and the exit tray 107B, shown by a solid line in FIG. 10, show a path to convey the sheet P ejected from the image forming apparatus to a sheet finishing section. Broken lines in FIG. 10 show a path by which a sheet, for which no sheet finishing is necessary, can be conveyed onto the exit tray 107 when the unit composed of the movable guide plate 101, the conveyance roller pair 3 and the exit tray 107B is oscillated downward.

Figure 11:
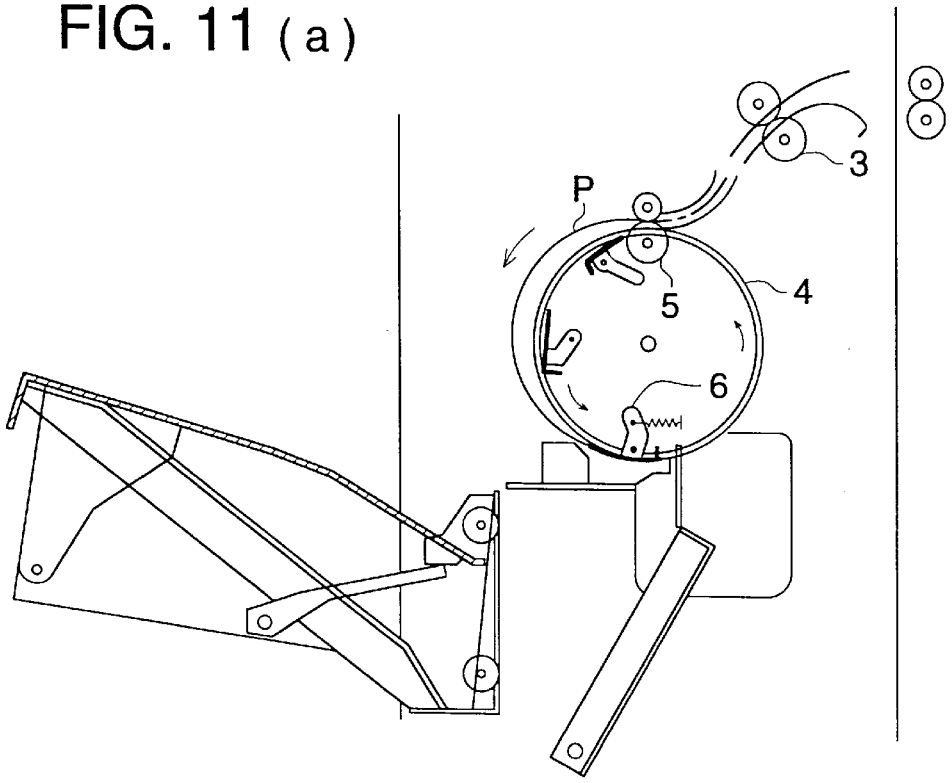
FIGS. 11(*a*) to 11(*f*) are partial sectional views showing sheet conveyance processes of the sheet finishing apparatus.
Figure 11:
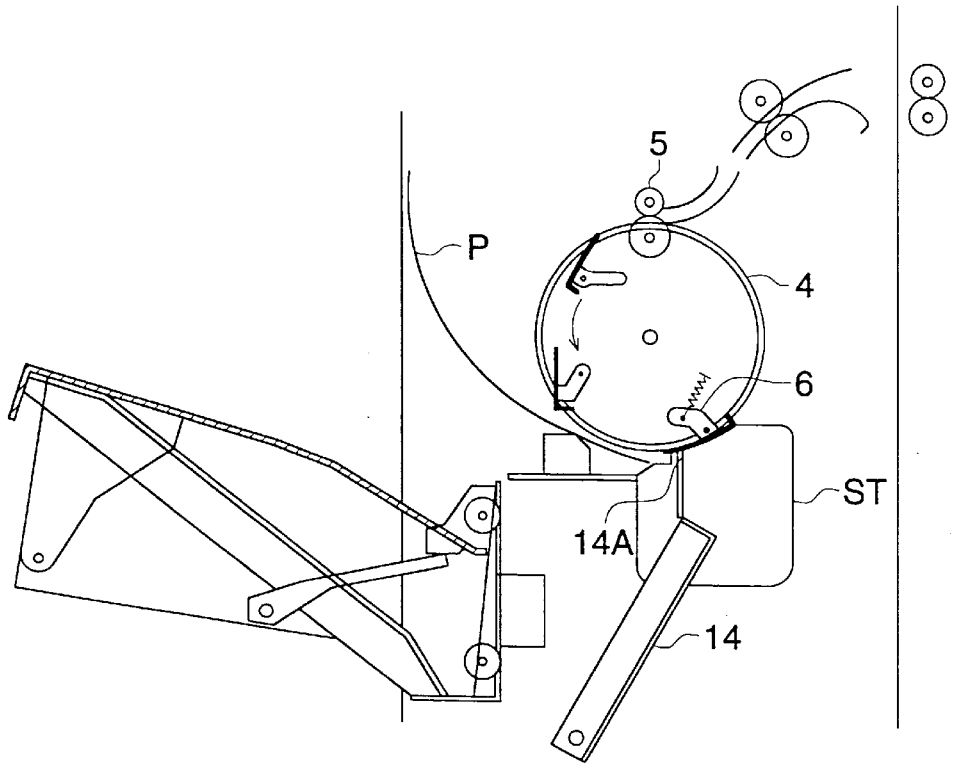
Figure 11:
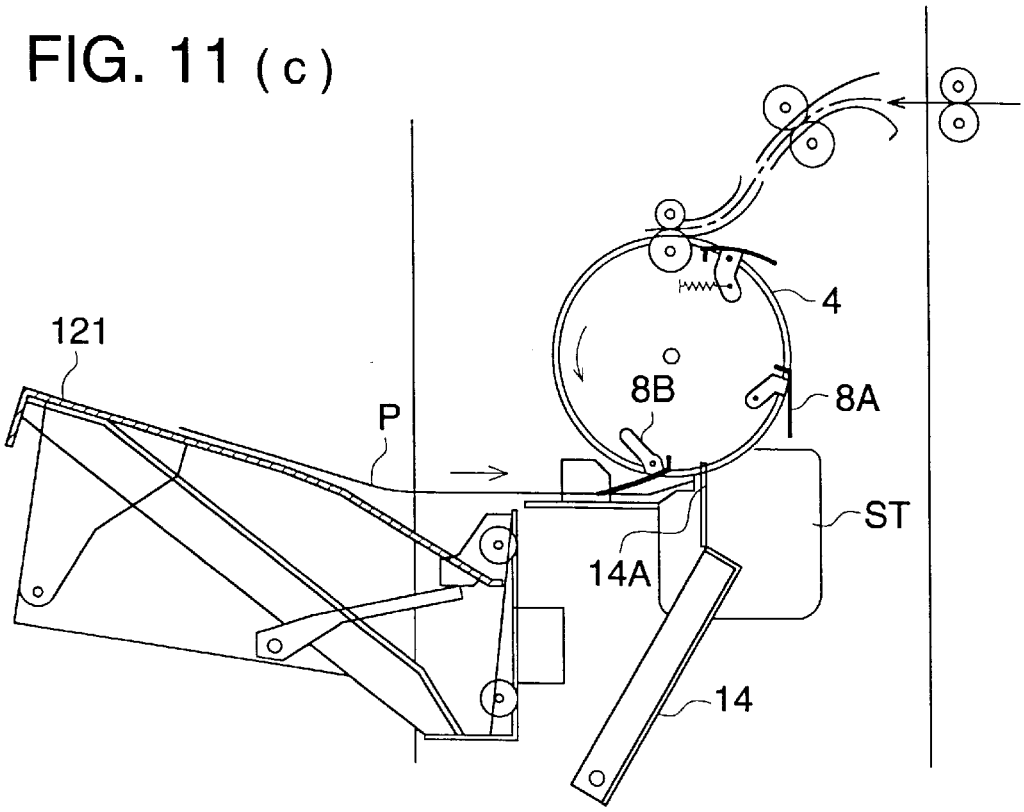
Figure 11:
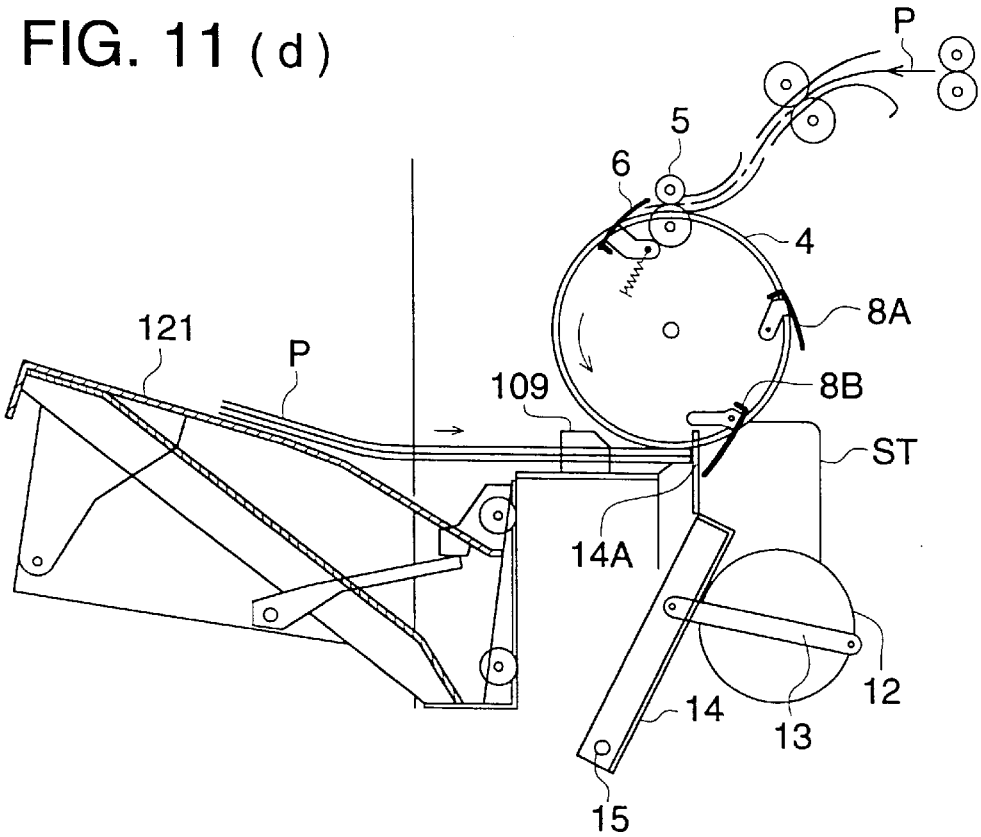
Figure 11:
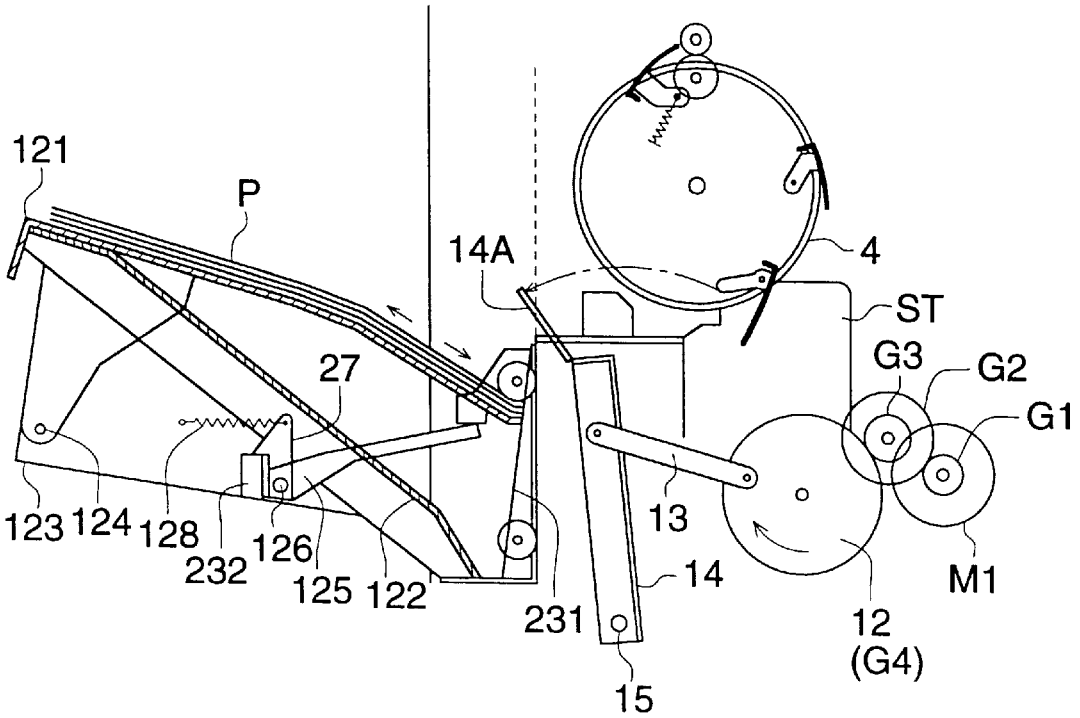
Figure 11:
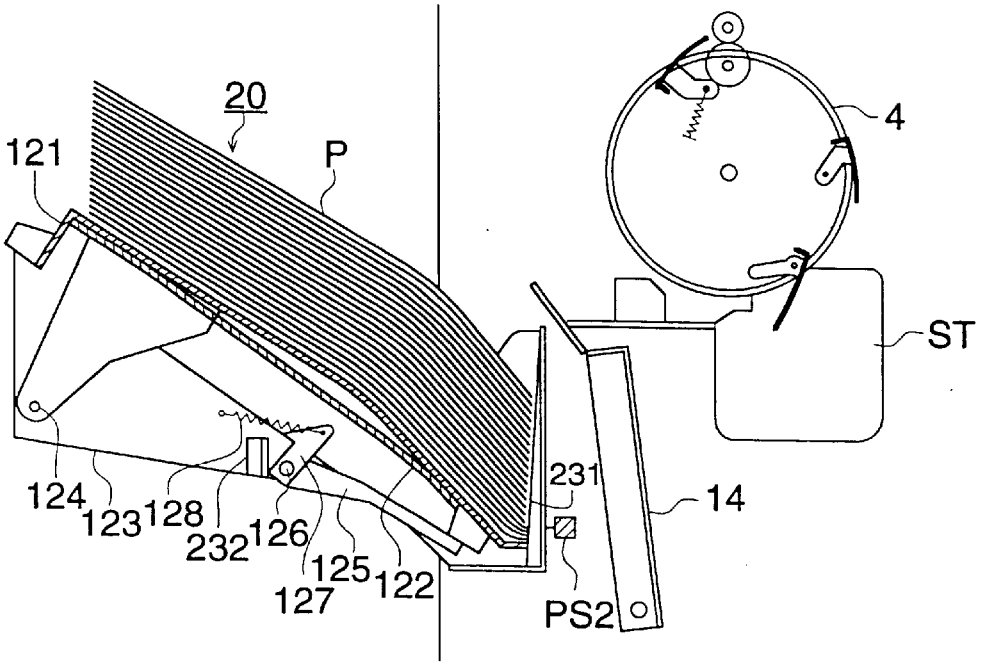

FIGS. 11(*a*) to 11(*f*) are partial sectional views showing sheet conveyance processes of the sheet finishing apparatus.

In FIG. 11(*a*), when the speed of the conveyance roller pair 5 is increased while the leading edge portion of the sheet P is brought into pressure contact with and held by the leading edge portion of the sheet pressing member 6 pushed by a spring, and is conveyed, on the peripheral surface of the rotating sheet reverse conveyance drum 4, the leading edge portion of the sheet P is held by the sheet pressing member 6, however, the speed of a portion near the trailing edge portion of the sheet P is increased by the conveyance roller pair 5, and the sheet P is excessively sent out, thereby the intermediate portion of the sheet P is separated from the peripheral surface of the sheet reverse conveyance drum 4, and swells outward.

In FIG. 11(*b*), when the sheet reverse conveyance drum 4 continues to be further rotated, the sheet P is reversed by the conveyance force of the conveyance roller pair 5 and the rigidity of the sheet P at an instant when the trailing edge portion of the sheet P is separated from the nipping position of the conveyance roller pair 5, and thereby, the sheet P is separated from the peripheral surface of the sheet reverse conveyance drum 4. When the leading edge portion of the sheet P reaches, comes into contact with the leading edge portion 14A of the ejection arm 14 which is stopped near the stapler ST, and stops, the sheet pressing member 6 is separated from the sheet P.

When the sheet reverse conveyance drum 4 further continues to be rotated, 2 sheet arranging members 8A and 8B, rotatably supported at 2 portions in the sheet reverse conveyance drum 4, successively sliding contact with near the leading edge portion of the sheet P, the leading edge portion of the sheet P is brought into contact with the leading edge portion 14A of the ejection arm 14 and stops, and the sheet P is arranged in the direction of conveyance, as shown in FIG. 11(*c*). The trailing edge portion of the arranged sheet P is placed on a movable exit tray 121.

In a process shown in FIG. 11(*d*), in which the leading edge portion of the sheet P is brought into contact with the leading edge portion 14A of the ejection arm 14, the alignment plate of a shift alignment means 109, which will be described later, arranges (alignment in width) the sheet P in the direction of width (the direction perpendicular to the sheet conveyance direction). Alternatively, when the operation mode is set to the shift mode, the alignment plate is successively shifted to predetermined plural positions, and the alignment is conducted in the direction of width. After the sheet reverse conveyance drum 4 is rotated once and positioning of the first sheet P has been completed, the second sheet P is sent to the sheet reverse conveyance drum 4, conveyed in the same manner as described above, positioned and stops. When the number of sheets P, which is brought into contact with the leading edge portion 14A and positioned in this manner, reaches a predetermined number, the sheets P are stapled at a predetermined position by a stapler ST and bound together (refer to 11(*d*)). In this connection, when the operation mode is set to the shift mode, the shift operation is conducted by the alignment plate.

FIG. 11(*e*) shows a condition that the sheets P, for which sheet finishing such as stapling, shifting, etc., has been completed, are ejected onto the movable exit tray 121.

A driving motor M1 drives a disk 12 through a gear train composed of gears G1, G2, G3, and G4. The other end of a crank 13, whose one end is supported at an eccentric position of the disk 12, is pivotally supported rotatably by a portion of the ejection arm 14 which can oscillate around a fulcrum shaft 15. The disk 12 driven by the driving source, eccentrically moves the crank 13, and further oscillates the ejection arm 14. By this oscillation movement of the ejection arm 14, the leading edge portion 14A of the ejection arm 14 presses the leading edge portion of the sheet P for which sheet finishing has been completed, and pushes out the sheet P from the contact position of the leading edge portion 14A toward the movable exit tray 121. The sheet P pushed out by the ejection arm 14 slides on the upper surface of the movable exit tray 121, then, the leading edge portion of the sheet P is lowered by its own weight, and comes into contact with the stopper surface 231 provided on the frame 123 which supports the movable exit tray 121, and stops. The leading edge portion 14A of the ejection arm 14 advances to the movable exit tray 121 side from above the stopper surface 231 in the vertical direction, and thereby the set of sheets does not remain in the finishing section and is securely moved onto the sheet stacking section.

The movable exit tray 121 is oscillatably supported by a fulcrum shaft 124 studded on the frame 123. The leading edge portion of an oscillation lever 125 comes into contact with the bottom surface of the right leading edge portion, in the drawing, of the movable exit tray 121, and moves up and down the movable exit tray 121. The base portion of the oscillation lever 125 is pivotally supported by a fulcrum shaft 126, and can be oscillated. An engagement member 127 integrated with the oscillation lever 125 can be oscillated on one end of the fulcrum shaft 126. The engagement member 127 is pushed by a spring 128, and moves up the leading edge portion of the oscillation lever 125. Due to this, the leading edge portion of the movable exit tray 121 is lifted up, and is oscillated counterclockwise, in the drawing, around the fulcrum shaft 124. The claw portion of the leading edge of the engagement member 127 is detachably engaged with an engagement portion 232 provided on the frame 123, thereby, the oscillation lever 125 is prevented from oscillating over a predetermined position, and accordingly, the leading edge portion of the movable exit tray 121 is pushed by a spring and held at a predetermined height.

As shown in FIG. 11(*f*), when the number of the finished sheets P stacked on the movable exit tray 121 is gradually increased, the leading edge portion of the movable exit tray 121 is lowered against the pushing force by the spring 128, and pushes down the oscillation lever 125. Thereby, the engagement of the engagement member 127 with the engagement portion 232 is disengaged, and further, the leading edge portion of the movable exit tray 121 is gradually lowered. During the lowering process of the movable exit tray 121, the uppermost layer of the sheet P stacked on the movable exit tray 121 is held at a position at which the finishing processed sheets P are ejected from finishing section (stapling, shifting section).

When the finishing processed sheets P stacked on the movable exit tray 121 are gradually increased, and the movable exit tray 121 is gradually lowered and reaches the lower limit position, an actuator, not shown, provided on end of the movable exit tray 121 is detected by a sensor PS2 fixedly provided on the sheet finishing apparatus main body side, and detection signal is sent to a control section 80, which will be described later. In this connection, the sensor PS2 may be provided on the frame 123, and may detect the lower limit position of the movable exit tray 121.

Figure 12:
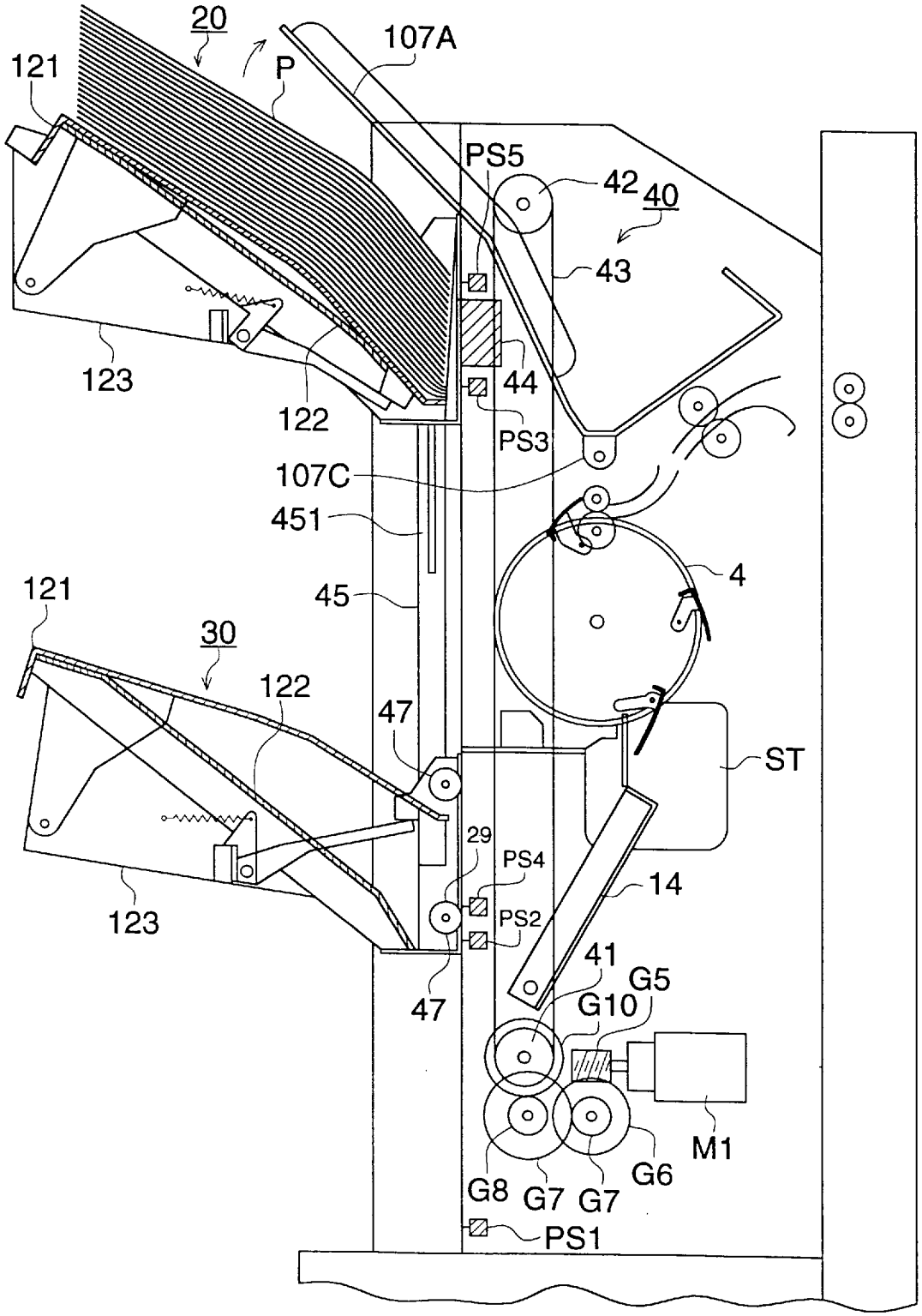
FIG. 12 is a sectional view showing a driving operation of the exit tray means in the sheet finishing apparatus provided with two exit tray means.

FIG. 12 is a sectional view showing the drive of the exit tray means in the sheet finishing apparatus provided with 2 stage exit tray means. The upper exit tray means 20 and the lower exit tray means 30 have the same structure, and therefore, the same numerals are used for explanation hereinafter. FIG. 10 shows a condition that the upper exit tray means 20 and the lower exit tray means 30 are lowered to a lower dead point and the finishing processed sheets P are accommodated on the upper exit tray means 20. FIG. 12 shows a condition that the upper exit tray means 20 and the lower exit tray means 30 are elevated to an upper dead point and the finishing processed sheets P are accommodated on the lower exit tray means 30. Referring to FIGS. 10 and 12, the elevation structure and the operation of the upper exit tray means 20 and the lower exit tray means 30 will be described below.

When the sensor PS2 detects that the finishing processed sheet P which is stacked on the movable exit tray 121 of the upper exit tray means 20, reaches the upper limit of the stacking volume, and the signal is generated, the control section, not shown, drives the driving motor M2 for tray elevation of the elevation driving means 40, and the upper exit tray means 20 is elevated. That is, the gear train composed of gears G5, G6, G7, G8, G9, G10 drives a drive pulley 41 by the drive of driving motor M2. A drive wire 43 is wound around the drive pulley 41 and an upper driven pulley 42. By the rotation of the drive pulley 41, the drive wire 43 is vertically reciprocated.

On a portion of the drive wire 43, the base portion of the frame of the upper exit tray means 20 is fixed by a exit tray hanging metal fittings 44. The frame 123 of the upper exit tray means 20 and the frame 123 of the lower exit tray means 30 are connected by a connecting rod 45. That is, a long groove portion 451 is provided in the connecting rod 45, and a pin 46 fixedly provided on the frame 123 of the upper exit tray means 20 slidingly contacts with the groove 451 (refer to FIG. 10). A near portion of the lower end portion of the connecting rod 45 is fixed on the frame 123 of the lower exit tray means 30.

When the upper exit tray means 20 is moved upward by the drive wire 43, the pin 46, fixedly provided on the frame 123 of the upper exit tray means 20, sliding-contacts with the long groove portion 451 of the connecting rod 45, and only the upper exit tray means 20 is moved upward. When the pin 46 contacts the uppermost end of the long groove portion 451 of the connecting rod 45, the distance between the moved upper exit tray means 20 and the stopped lower exit tray means 30 is maximum.

When the upper exit tray means 20 is further moved upward by the drive wire 43, the pin 46 of the upper exit tray means 20 moves the connecting rod 45 upward under the condition that the pin 46 is in contact with the long groove portion 451, thereby, the lower exit tray means 30 which is fixed on the lower end of the connecting rod 45, is lifted and moved.

Accordingly, the upper exit tray means 20 and the lower exit tray means 30 are integrally moved upward with the above-described maximum distance between them.

When the upper exit tray means 20 is further moved upward by the drive wire 43, the upper end portion of the frame 123 of the upper exit tray means 20 comes into contact with a portion of the bottom surface side of the left exit tray 107A, shown in the drawing, of the uppermost exit means 107, and pushes upward the exit tray 107A.

Due to this, the exit tray 107A is oscillated clockwise around the fulcrum shaft 107C and is withdrawn.

When the detection means (sensor) PS5 detects that the upper exit tray means 20 reaches the upper dead point, the drive of the drive motor M2 is stopped, and the upper exit tray means 20 and the lower exit tray means 30 are stopped. At this time, the lower exit tray means 30 is stopped at the position at which the finishing processed sheets P by the stapler ST are received.

Figure 13:
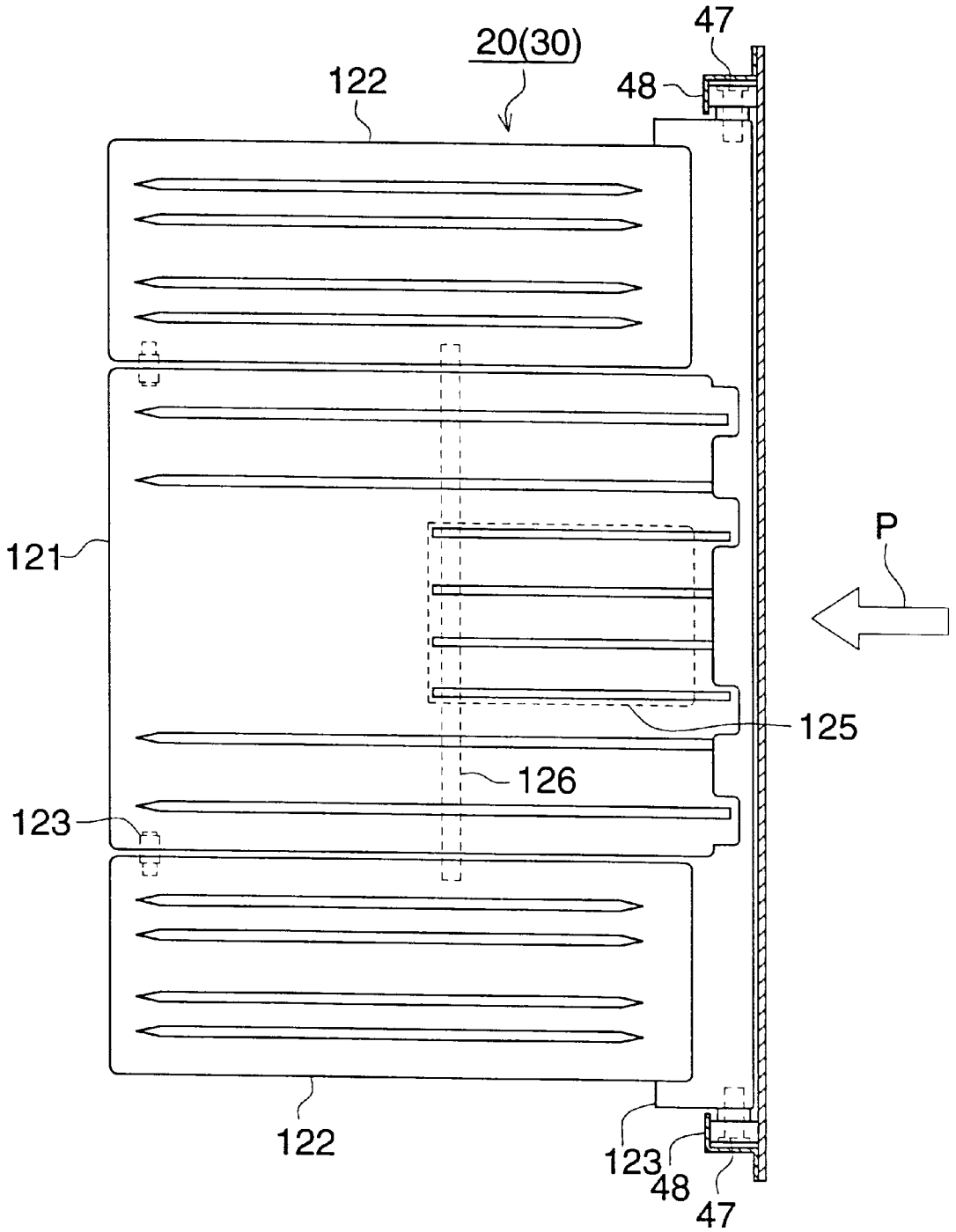
FIG. 13 is a plan view of the exit tray means.

FIG. 13 is a plan view of the exit tray means 20 (30). The movable exit tray 121 is placed at the central position in the direction of the width of the ejected sheet P, and is oscillatablly supported. On both sides of the movable exit tray 121 in the direction of the sheet width, 2 fixed exit trays 122 are fixed on the frame 123.

Total 4 guide rollers 47 are rotatably supported on both sides and upper and lower portions of the base portion of the frame 123 in the direction of the sheet width. When the guide roller 47 moves along the sliding surface of the guide rail 48 fixed on the sheet finishing apparatus main body, the upper exit tray means 20 and the lower exit tray means 30 are respectively moved upward and downward.

Figure 14:
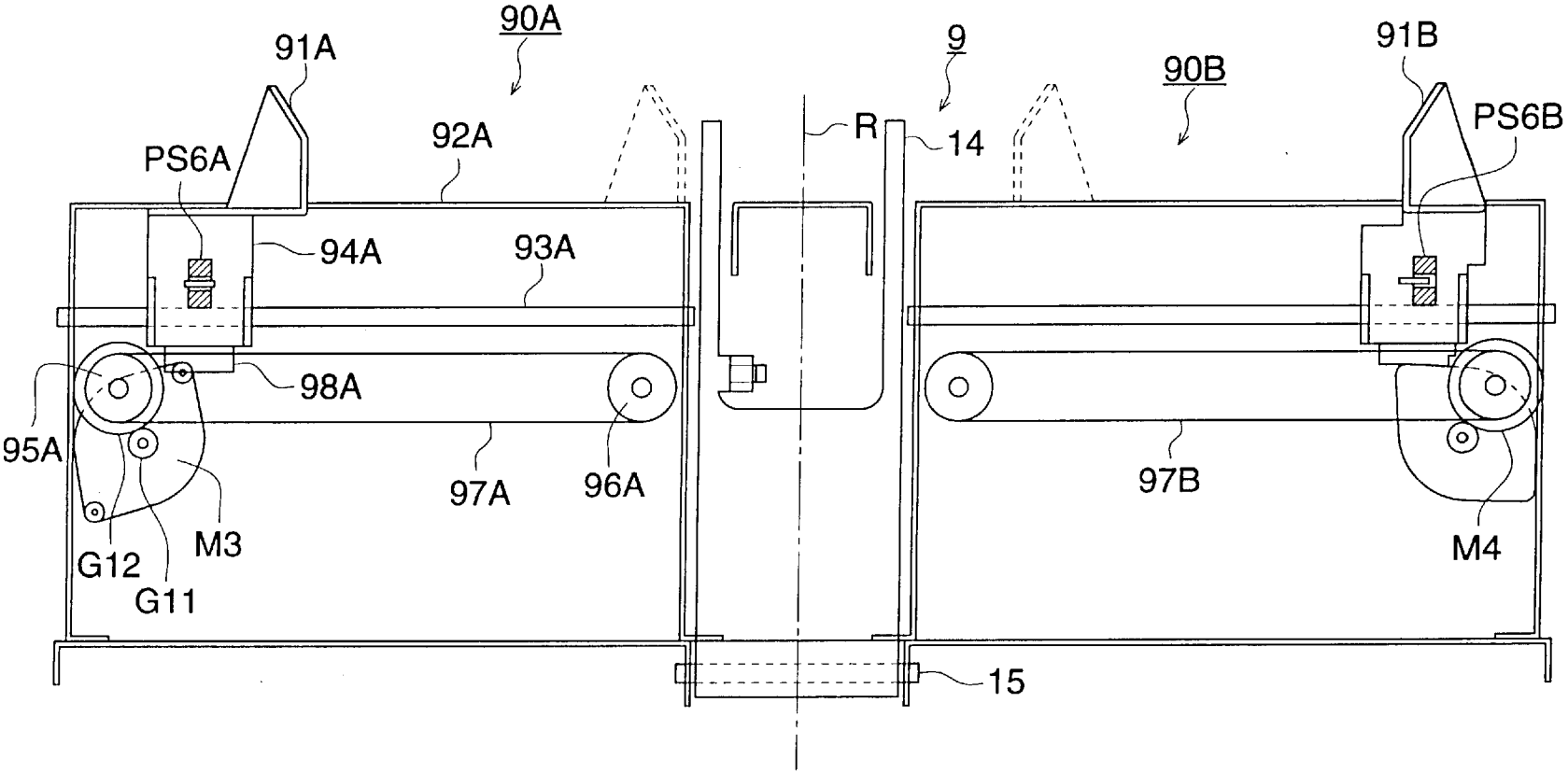
FIG. 14 is a front view of a shift alignment means.

FIG. 14 is a front view of a shift alignment means 109.

The shift alignment means 109 is composed of a left first unit 90A to move one alignment plate 91A, and a right second unit 90B to move the other alignment plate 91B, in the drawing. These both units 90A and 90B have almost the same structure, and therefore, the first unit 90A will be explained as the representative, hereinafter.

The alignment plate 91A is fixed on a carriage 94A which slides and is movable on a guide bar 93A fixedly supported in a unit casing 92A. The carriage 94A is fixed on a portion of a timing belt 97A wound between a drive pulley 95A and a driven pulley 96A by a fixing member 98A. The drive pulley 95A is driven by a driving motor M3 of the driving source through gears G11 and G12. A PS6A and a PS6B are home position sensors. The alignment plates 91A and 91B respectively have a driving motor for exclusive use, and are independently movable.

Figure 15:
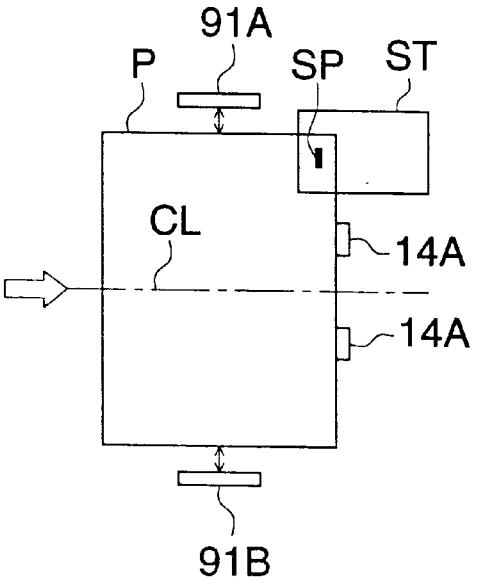
FIGS. 15(*a*) and 15(*b*) are illustrations showing operations of alignment plates during staple processing.
Figure 15:
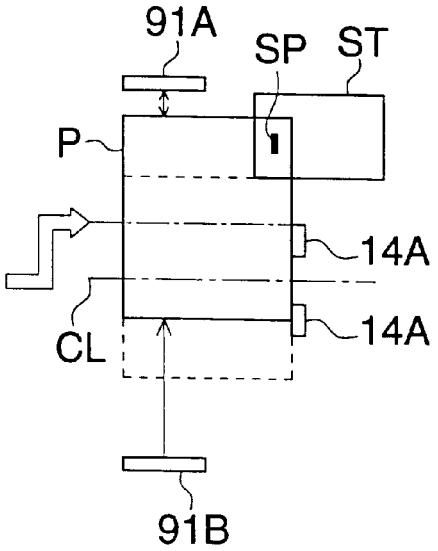

FIGS. 15(*a*) and 15(*b*) are illustrations showing operations of alignment plates 91A and 91B during stapling.

When a normal sized sheet P is stapled, as shown in FIG. 15(*a*), the alignment plates 91A and 91B are placed at an initial position at which they are opposed to each other and have equal distance with respect to the center line CL in the conveyance direction of the sheet P, and the distance between them is larger than the sheet width. Every time when the sheet P is sent from the sheet reverse conveyance drum 4 to the stapler ST and comes into contact with the leading edge portion 14A of the delivery arm 14, the alignment plates 91A and 91B start to move from the initial position and align the sheet width by knocking side edges of the sheets.

When a small sized (for example, AS sized) sheet P is stapled, as shown in FIG. 15(*b*), every time when the sheet p is sent from the sheet reverse conveyance drum 4 to the stapler ST and comes into contact with the leading edge portion 14A, one alignment plate 91B starts to move from its initial position and presses the side edge of the sheet P, and shifts the sheet P. In addition to that, the other alignment plate 91A starts to move from its initial position, and aligns the sheet width by knocking the side edge of the sheet P.

Figure 16:
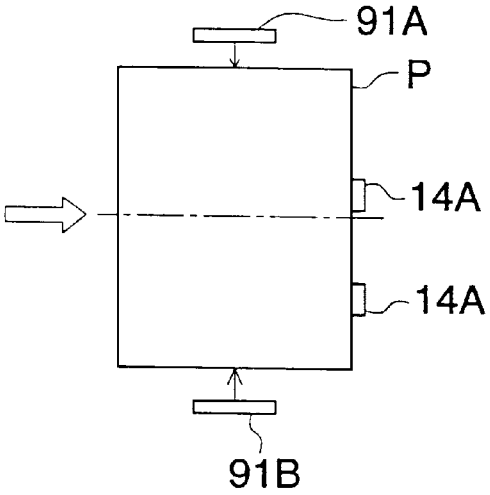
FIGS. 16(*a*) and 16(*b*) are illustrations showing operations of the alignment plates during shift processing.
Figure 16:
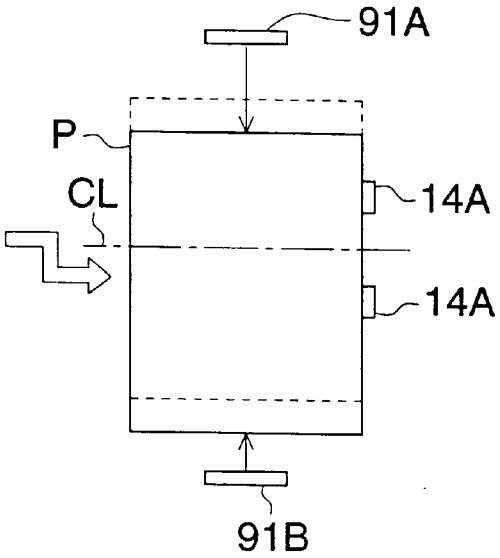

FIGS. 16(*a*) and 16(*b*) are illustrations showing operations of alignment plates 91A and 91B during shifting.

FIG. 16(*a*) shows a condition that an odd numbered set of sheets is processed. When the operation mode is set to the shifting mode (offset mode), the alignment plates 91A and 91B respectively move by equal distance from each initial position, in which the distance is equal with respect to the center line CL in the conveyance direction of the sheet P, and stop at the first position at which the width is slightly larger than the sheet width, corresponding to the size of sheet. Then, the set of sheets is received, finishing processed, and delivered.

FIG. 16(*b*) shows the condition that an even numbered set of sheets is shifting processed. After the even numbered set of sheets is received at the same position as that of the odd numbered set of sheets, the alignment plates 91A and 91B are respectively moved, and stop at positions at which the each distance is unequal with respect to the center line CL in the conveyance direction of the sheet P, and then, the sheet P is finishing processed and delivered. In this connection, in this shifting mode, the width alignment may be carried out.

Figure 17:
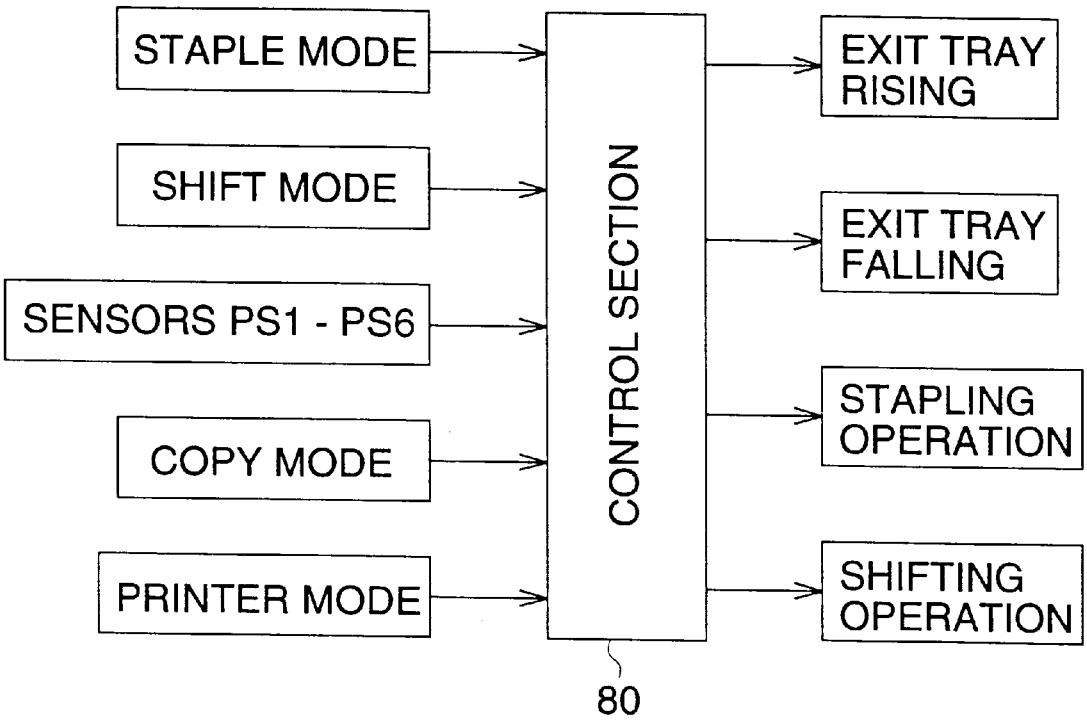
FIG. 17 is a block diagram showing a control system of the sheet finishing apparatus according to the present invention.

FIG. 17 is a block diagram showing the control of the sheet finishing apparatus according to the present invention.

In FIGS. 10 and 12, sensors PS1, PS2, and PS3 to detect the lower limit position of the movable exit tray 121, send the detection signal that the sheets P stacked on the movable exit tray 121 reach the upper limit of the stacking volume, at respective stop positions of the exit tray means 20 and 30, to a control section 80, which will be described later. That is, the sensor PS1 detects the lower limit position of the movable exit tray 121 at the lower dead point position of the lower exit tray means 30. The sensor PS2 detects the lower limit position of the movable exit tray 121 at a position at which the upper exit tray means 20 and the lower exit tray means 30 eject the sheets P on the movable exit tray 121 after sheet finishing. The sensor PS3 detects the lower limit position of the movable exit tray 121 at the upper dead point position of the upper exit tray means 20.

The elevating operations of the upper and lower exit tray means 20 and 30, and the control by the sensors PS1–PS3 will be described below.

(1) In the sheet finishing apparatus, a detection signal is sent to the control section 80 when the sensor PS2 detects that sheet finished sets of sheets are stacked on the movable exit tray 121 of the upper exit tray means 20, the movable exit tray 121 reaches the lower limit position, and the sheets P reach the upper limit stacking volume. By this detection signal, the control section 80 drives the driving motor M2, elevates the upper exit tray means 20, and elevates the lower exit tray means 30, following the upper exit tray means 20.

(2) After the lower exit tray means 30 stops at a predetermined sheet finishing position, a detection signal is sent to the control section 80 when the sensor PS2 detects that sheet-finished sets of sheets are stacked on the movable exit tray 121 of the lower exit tray means 30, the movable exit tray 121 reaches the lower limit position, and the sheets P reach the upper limit stacking volume. When the sheets P stacked on both exit tray means 20 and 30 reach the upper limit stacking volume, the sheet-finishing is stopped.

(3) During the above sheet finishing, when the finishing processed sheets P on both exit tray means 20 and 30 are pulled out, the self weight of the sheets P on the movable exit tray 121 is decreased, the movable exit tray 121 is moved up by the spring force, the sensor PS2 transmits a signal that the sheet P can be stacked, and the sheet finishing is continued.

(4) During or after sheet finishing, when the finishing processed sheets P on the other exit tray means (the lower exit tray means 30 in FIG. 10 or the upper exit tray means 20 in FIG. 12) are pulled out, the self weight of the sheets P on the movable exit tray 121 is decreased, the movable exit tray 121 is moved up by the spring force, the sensor PS1 or PS3 transmits a signal that the sheet P can be stacked, and after the exit tray means is moved, the sheet finishing is continued.

As described above, during sheet finishing, by arbitrarily pulling out the sheet finishing processed sheets P on the upper and lower exit tray means 20 and 30, the sheet finishing operation can be continued and a large number of sheets P can be finishing processed.

Further, the following can also be attained: the sheet finishing means composed of one stapler ST and one shift alignment means 109, the upper and lower exit tray means 20 and 30 on which sets of sheets, processed by the sheet finishing means and delivered, are stacked, and the elevation driving means 40 to elevate these plural upper and lower exit tray means 20 and 30, are provided; and the sheet P formed by the staple processing mode is ejected and stacked on one exit tray means 20 (or 30), the exit tray means 20 (or 30) is elevated, and the sheet P formed by the shift processing mode is ejected and stacked on the other exit tray means 30 (or 20). Thereby, the staple processing and shift processing can be easily carried out continuously.

In this connection, in the example of the present invention, the sheet finishing apparatus connected to the copier was shown, however, the present invention can also be applied to the sheet finishing apparatus connected to an image forming apparatus such as a printer, facsimile device, etc., or a light printing machine.

By the sheet finishing apparatus of the present invention, the following excellent effects can be obtained.

(1) The sheet finishing apparatus is provided with a sheet finishing means, a plurality of exit tray means on which sets of sheets, processed by the sheet finishing means and ejected, are stacked, a sensor to detect a predetermined maximum capacity of the sets of sheets stacked on the exit tray means, an elevation driving means to elevate the plurality of exit tray means, and a control means; when the sensor detects that the sheets, ejected from the sheet finishing means and stacked on either exit tray means, reach a predetermined maximum stacking volume, the elevation driving means is driven, the exit tray means is elevated, and the sheets are ejected from the sheet finishing means onto the other exit tray means and stacked thereon, thereby a large number of sheets can be continuously stacked and accommodated. Further, during the sheet finishing, when the finishing processed sheets are pulled out, sheet finishing can be continued in succession. Accordingly, without delaying and stopping the image formation and continuous sheet ejection of the image forming apparatus, a large number of sheets are effectively finishing processed, thereby, the productivity can be increased.

(2) The sheet finishing means composed of a stapler ST and a shift alignment means, an exit tray means on which sets of sheets, processed by the sheet finishing means and ejected, are stacked, and the elevation driving means 40 to elevate a plural exit tray means, are provided; and after the sheet P formed by the staple processing mode is ejected and stacked on one exit tray means, the exit tray means is elevated, and the sheet P formed by the shift processing mode is ejected and stacked on the other exit tray means. Thereby, the following excellent effects can be obtained: the staple processing and shift processing can be divided from each other, and easily carried out continuously. Further, a conveyance means or delivery sheet means is not necessary, thereby, the size of the sheet finishing apparatus can be reduced.

What is claimed is:

1. A sheet finishing apparatus for finishing a sheet on which an image has been formed and which has been conveyed from an image forming apparatus, the sheet finishing apparatus comprising:

(a) a sheet ejecting member for ejecting the sheet after finishing; and (b) an exit tray for receiving the ejected sheet, said exit tray comprising:

a movable exit tray member having a sheet stacking surface on which the sheet is stacked, and a stopper portion provided adjacent to the sheet ejecting member to bring an edge of the sheet into contact with the stopper portion; and a stationary exit tray member having a supporting shaft at a leading edge portion, and pivotally supporting the movable exit tray member around the supporting shaft so that an edge portion of the movable exit tray member, which is adjacent to the sheet ejecting member, can be moved upward or downward according to a weight of sheets stacked on the movable exit tray member;

wherein the sheet stacking surface of the movable exit tray member comprises a slanting surface which in the vicinity of the stopper portion is lower than the leading edge portion of the stationary exit tray member; and wherein the stationary exit tray member has a sheet stacking surface in a vicinity of an edge of the exit tray in a width direction perpendicular to a sheet ejecting direction, and the sheet stacking surface of the movable exit tray member is provided in a vicinity of a center of the exit tray in the width direction perpendicular to the sheet ejecting direction.

2. A sheet finishing apparatus for finishing a sheet on which an image has been formed and which has been conveyed from an image forming apparatus, the sheet finishing apparatus comprising:

(a) a sheet finishing member for finishing the sheet;

(b) a sheet ejecting member for ejecting the finished sheet;

(c) a plurality of exit trays, which can be switched over each other against the sheet ejecting member by upward or downward movement, for receiving the finished sheet ejected by the sheet ejecting member, each of said plurality of exit trays comprising:

a movable exit tray member having a sheet stacking surface on which the sheet is stacked, and a stopper portion provided adjacent to the sheet ejecting member to bring an edge of the sheet into contact with the stopper portion; and a stationary exit tray member having a supporting shaft at a leading edge portion, and pivotally supporting the movable exit tray member around the supporting shaft so that an edge portion of the movable exit tray member, which is adjacent to the sheet ejecting member, can be moved upward or downward according to a weight of sheets stacked on the movable exit tray member;

(d) a driving member for moving the plurality of exit trays upward or downward;

(e) a controller for controlling the driving member; and (f) a sensor for detecting sheet ejection and stacking on a given one of the plurality of exit trays;

wherein when the sensor detects a predetermined maximum number of sheets ejected and stacked on the given one of the plurality of exit trays, the controller controls the driving member to move the plurality of exit trays so that succeeding sheets ejected by the sheet ejecting member are ejected and stacked on a different one of the plurality of exit trays.

3. The sheet finishing apparatus of claim 2, wherein the sheet finishing member comprises a stapling device for stapling sheets on which an image has been formed.

4. The sheet finishing apparatus of claim 2, wherein the sheet finishing member comprises a shifting device for shifting sheets on which an image has been formed in a direction perpendicular to a sheet ejecting direction.

5. A sheet finishing apparatus for finishing a sheet on which an image has been formed and which has been conveyed from an image forming apparatus, the sheet finishing apparatus comprising:

(a) a sheet finishing member for finishing the sheet;

(b) a sheet ejecting member for ejecting the finished sheet;

(c) a plurality of exit trays, which can be switched over each other against the sheet ejecting member by upward or downward movement, for receiving the finished sheet ejected by the sheet ejecting member, each of the plurality of exit trays comprising:

a movable exit tray member having a sheet stacking surface on which the sheet is stacked, and a stopper portion provided adjacent to the sheet ejecting member to bring an edge of the sheet into contact with the stopper portion; and a stationary exit tray member having a supporting shaft at a leading edge portion, and pivotally supporting the movable exit tray member around the supporting shaft so that an edge portion of the movable exit tray member, which is adjacent to the sheet ejecting member, can be moved upward or downward according to a weight of sheets stacked on the movable exit tray member;

(d) a driving member for moving the plurality of exit trays upward or downward; and (e) a controller for controlling the driving member;

wherein after sheets formed in a predetermined image forming mode are ejected and stacked on a given one of the plurality of exit trays, the controller controls the driving member to move the plurality of exit trays so that succeeding sheets, which are formed in an image forming mode different from the predetermined image forming mode, are ejected and stacked on a different one of the plurality of exit trays.

6. A sheet finishing apparatus for finishing a sheet on which an image has been formed and which has been conveyed from an image forming apparatus, the sheet finishing apparatus comprising:

(a) a sheet ejecting member for ejecting the sheet after finishing; and (b) an exit tray for receiving the ejected sheet, said exit tray comprising:

a movable exit tray member having a sheet stacking surface on which the sheet is stacked, and a stopper portion provided adjacent to the sheet ejecting member to bring an edge of the sheet into contact with the stopper portion; and a stationary exit tray member having a supporting shaft at a leading edge portion, and pivotally supporting the movable exit tray member around the supporting shaft so that an edge portion of the movable exit tray member, which is adjacent to the sheet ejecting member, can be moved upward or downward according to a weight of sheets stacked on the movable exit tray member;

wherein when sheets stacked on the exit tray are taken out while a finishing operation is conducted, the movable exit tray member is moved upward and a sensor generates a signal indicating that further sheets can be stacked on said exit tray, thereby enabling the finishing operation to be continued.

7. The sheet finishing apparatus of claim 6, wherein the exit tray comprises a plurality of exit trays which can be switched over each other against the sheet ejecting member by upward or downward movement.

8. The sheet finishing apparatus of claim 7, wherein each of the plurality of exit trays is capable of being moved upward or downward by a driving member.

9. A sheet finishing apparatus for finishing a sheet on which an image has been formed and which has been conveyed from an image forming apparatus, the sheet finishing apparatus comprising:

(a) a sheet ejecting member for ejecting the sheet after finishing;

(b) a plurality of exit trays, which can be switched over each other against the sheet ejecting member by upward or downward movement, for receiving the ejected sheet, each of said plurality of exit trays comprising:

a movable exit tray member having a sheet stacking surface on which the sheet is stacked, and a stopper portion provided adjacent to the sheet ejecting member to bring an edge of the sheet into contact with the stopper portion; and a stationary exit tray member having a supporting shaft at a leading edge portion, and pivotally supporting the movable exit tray member around the supporting shaft so that an edge portion of the movable exit tray member, which is adjacent to the sheet ejecting member, can be moved upward or downward according to a weight of sheets stacked on the movable exit tray member;

(c) a driving member for moving the plurality of exit trays upward or downward using a single driving source; and (d) a coupling member for coupling the plurality of exit trays;

wherein when the plurality of exit trays are moved upward by the driving member so that a lower exit tray of the plurality of exit trays is arranged against the sheet ejecting member, a distance between an upper exit tray of the plurality of exit trays and the lower exit tray is extended by the coupling member.

* * * * *